US007130566B2

(12) United States Patent
Nagahama et al.

(10) Patent No.: US 7,130,566 B2
(45) Date of Patent: Oct. 31, 2006

(54) DEVELOPER CONTAINER AND IMAGE FORMING APPARATUS

(75) Inventors: Hitoshi Nagahama, Uji (JP); Masanobu Deguchi, Kashiba (JP); Kazuya Koyama, Ikoma (JP); Shigeki Hayashi, Ikoma-gun (JP)

(73) Assignee: Sharp Kabusiki Kaisha, Osaka (JP)

( * ) Notice: Subject to any disclaimer, the term of this patent is extended or adjusted under 35 U.S.C. 154(b) by 19 days.

(21) Appl. No.: 10/925,950

(22) Filed: Aug. 26, 2004

(65) Prior Publication Data

US 2005/0058471 A1 Mar. 17, 2005

(30) Foreign Application Priority Data

Aug. 29, 2003 (JP) ..... 2003-307802

(51) Int. Cl.
*G03G 15/04* (2006.01)
*G03G 15/08* (2006.01)

(52) U.S. Cl. ..... 399/262; 399/120; 222/DIG. 1

(58) Field of Classification Search ..... 399/262, 399/120, 158, 263; 222/DIG. 1
See application file for complete search history.

(56) References Cited

U.S. PATENT DOCUMENTS

| | | | | |
|---|---|---|---|---|
| 6,141,520 | A * | 10/2000 | Kosuge | 399/262 |
| 6,259,877 | B1 * | 7/2001 | Taniyama et al. | 399/262 |
| 2005/0135842 | A1 * | 6/2005 | Murakami et al. | 399/262 |

FOREIGN PATENT DOCUMENTS

| | | | |
|---|---|---|---|
| JP | 62-190264 | U | 12/1987 |
| JP | 3-203760 | A | 9/1991 |
| JP | 6-102758 | A | 4/1994 |
| JP | 6-222665 | A | 8/1994 |
| JP | 7-271168 | A | 10/1995 |
| JP | 8-62981 | A | 3/1996 |
| JP | 8-339115 | A | 12/1996 |
| JP | 11-223990 | A | 8/1999 |
| JP | 2000-296549 | A | 10/2000 |
| JP | 2002-214893 | A | 7/2002 |
| JP | 2002-372844 | A | 12/2002 |
| JP | 2003-57927 | A | 2/2003 |
| JP | 2003-241496 | A | 8/2003 |

* cited by examiner

*Primary Examiner*—David M. Gray
*Assistant Examiner*—Joseph S. Wong
(74) *Attorney, Agent, or Firm*—Birch, Stewart, Kolasch & Birch, LLP

(57) ABSTRACT

A developer container of the present invention includes a container main body and a supporting member. The container main body is used to contain a developer. The supporting member supports the container main body in such a manner that the container main body is freely rotatable. Further, the container main body includes an inwardly depressed recess portion on its outer peripheral surface. In that recess portion, a discharging opening is provided to discharge the developer into that recess portion opposite the direction in which the container main body rotates around the axis of rotation. Further, a regulating member having a tube-like shape is provided which surrounds the discharging opening to regulate the discharged amount of the developer.

14 Claims, 25 Drawing Sheets

CONVENTIONAL ART

DEVELOPER CONTAINER AND IMAGE FORMING APPARATUS

This Nonprovisional application claims priority under 35 U.S.C. § 119(a) on Patent Application No. 2003/307802 filed in Japan on Aug. 29, 2003, the entire contents of which are hereby incorporated by reference.

FIELD OF THE INVENTION

The present invention relates to a developer container for containing a developer, such as a toner, for electro-photographical image forming, and to an image forming apparatus in which the developer container is detachably provided.

BACKGROUND OF THE INVENTION

An image forming apparatus—such as a photocopier, a printer, and a facsimile—uses a developer, such as a toner, to develop an image. Generally, in such an image forming apparatus, a developer container such as a toner cartridge is provided. The developer container contains (stores) the developer, and supplies the developer to a developing section of the image forming apparatus during development.

Incidentally, in recent years, there has been a demand for an image forming apparatus which can print a large amount of documents at high speed. For example, there is such an image forming apparatus (the type that can form images on 50 or greater sheets of paper for one minute) that can handle 999 sheets at a time. Further, the image forming apparatus occasionally carries out a continuous printing for over 999 sheets, depending on a setting of the printing. Therefore, such a fast image forming apparatus needs a toner cartridge that can contain a large amount of toner, and some toner cartridges can contain, for example, approximately 1400 g of toner.

Disclosed in Japanese Laid-Open Patent Application Tokukaihei 08-339115/1996 (published on Dec. 24, 1996; hereinafter, referred to as "Reference 1") is a specific example of a toner cartridge (supplying developer container) that can contain a large amount of toner. FIG. 25 is a perspective view illustrating the supplying developer container 20 described in Reference 1. The supplying developer container 20 has a cylindrical shape whose ends are closed, and has a containing space for toner. The supplying developer container 20 includes supplying means (first protruding ledge) 21*a*, and supplying means (second protruding ledge) 21*b*. The supplying means 21*a* inwardly protrudes in a radial direction of the supplying developer container 20, and spirally extends, from a first end portion 20*a* of the supplying developer container 20 to a central portion 20*c* of the supplying developer container 20, with respect to an axis line L20, the first end portion 20*a* being one end in the axis line L20, and the central portion being in a center of the axis line L20. Meanwhile, the supplying means 21*b* inwardly protrudes in the radial direction of the supplying developer container 20, and spirally extends, from its second end portion 20*b* to its central portion 20*c*, with respect to the axis line L20, the second end portion being the other end in the axis L20. In the central portion 20*c* of the supplying developer container 20, an outlet hole 22 is formed. The outlet hole 22 penetrates the supplying developer container 20, and connects the containing space to an outside of the supplying developer container 20.

The supplying developer container 20 is coupled with an image forming apparatus main body (not shown) so that the axis line L20 is parallel to a horizontal direction, and that the central portion 20*c* is positionally associated with a toner supplying hole (not shown) which is provided in the image forming apparatus main body, the toner supplying hole being open upward. The supplying developer container 20 is driven, to rotate around the axis line L20, by a driving section provided on the image forming apparatus main body. By doing this, the toner contained in the containing space is sent to the central portion 20*c* by the supplying means 21*a* and 21*b*. When the outlet hole 22 comes to a position to face the toner supplying hole, the toner is supplied, via the outlet hole 22, to the toner supplying hole.

As described above, the supplying developer container 20 of Reference 1 contains toner, and rotates to supply the toner to the outlet hole 22 by the supplying means 21*a* and 21*b*, both of which extend to the outlet hole 22. Thereafter, the developer thus supplied is discharged from the outlet hole 22, thereby supplying the developer to a developing apparatus (not shown) provided in the image forming apparatus. Therefore, if the supplying toner container 20 is provided in the image forming apparatus so that the outlet hole 22 can be disposed above the toner supplying hole which supplies the toner to the developing apparatus, a space that is not efficiently used is reduced. Accordingly, the supplying developer container 20 can contain larger amounts of toner.

However, it is difficult to attain a complete seal between the image forming apparatus main body and the central portion 20*c* that rotates. Accordingly, when the supplying developer container 20 rotates, the toner possibly leaks from a space between the central portion and the image forming apparatus main body, and possibly flies about inside the image forming apparatus main body.

Further, a toner is a fine particle having a particle diameter of 4 μm to 10 μm, and is highly flowable. Therefore, in cases where the rotation of the supplying developer container 20 is stopped when the outlet hole 22 faces the toner supplying hole, a large amount of toner possibly flows into the toner supplying hole via the outlet hole 22. When the toner is over supplied from the toner supplying hole to the developing section, toner density in the developing apparatus is increased at the time of the oversupply. This possibly causes images to be unevenly developed.

Further, under the supplying developer container 20, the developing apparatus is provided. Therefore, due to a load (i.e. weight of the toner) imposed on the toner, the toner flows into the developing apparatus via the outlet hole 22. Accordingly, depending on the load imposed on the toner (i.e., amount of toner left in the supplying developer container 20), an amount of the toner to be supplied is varied. This leads to unstable supply of the toner to the developing apparatus.

Specifically, when a large amount of the toner is contained in the supplying developer container 20, a heavy load is imposed on the toner, thereby increasing the amount of the toner to be supplied to the developing apparatus due to its weight. Further, in this case, the toner density increase due to pressure caused by its weight, and the amount of toner per unit volume becomes too large. As a result, the amount of the toner to be supplied is further increased. However, as the toner in the supplying developer container 20 decreases, the load imposed on the toner (i.e. the weight of the toner) decreases. This decreases the amount of the toner to be supplied to the developing apparatus. Further, because the toner as a result becomes less dense, and the amount of the toner per unit volume is reduced, the amount of the toner thus supplied is further reduced.

The supplying developer container 20 described in Reference 1 has such a problem that the amount of the toner to be supplied depends on the amount of the toner contained in the supplying developer container 20, and that the toner is therefore unstably supplied. When the toner is thus unstably supplied, images are not always evenly developed, thereby deteriorating image qualities. Further, when the amount of toner remaining in the supplying developer container 20 is small, the toner cannot be reliably supplied to the developing apparatus. A sensor, which detects how much toner is left, would possibly misunderstand that there is no toner left in the supplying developer container 20, and accordingly causes a message to be displayed advising to change the supplying developer container (toner cartridge), even when sufficient toner is still left in the supplying developer container 20.

SUMMARY OF THE INVENTION

The present invention is made in view of the foregoing conventional problems, and an object thereof is to provide a developer container, with which a toner is always evenly supplied to a developing section of an image forming apparatus, irrespective of an amount (particularly, weight of the toner) of the toner contained in the developer container.

To solve the problem, a developer container of the present invention includes: (1) a container main body, configured to be detachably provided in an image forming apparatus, and to contain a developer for use in image formation, the container main body having a cylindrical shape; and (2) a supporting member which supports the container main body in such a manner that the container main body is freely rotatable, wherein: (i) the container main body has a recess portion on its outer peripheral surface, the recess portion being inwardly depressed and having a discharging opening therein positioned to discharge the contained developer into the recess portion downstream of the direction of rotation of the container main body about an axis line (axis of rotation) of the container main body; (ii) the developer contained in the container main body is sent to the discharging opening by rotating the container main body around the axis line; (iii) the supporting member supports the container main body by wholly covering at least that portion of the container main body which includes the recess portion in such a manner that the container main body is freely rotatable about the axis line; (iv) the container main body includes a through opening for leading discharged developer from the recess portion to an outside of the container main body, and (v) a regulating member is provided, on that surface of the recess portion in which the discharging opening is provided for regulating the amount of developer discharged through said discharging opening.

As described above, the developer container of the present invention includes the container main body and the supporting member, and the regulating member is provided substantially along the rotation direction of the container main body so as to regulate the discharging amount of the developer. This prevents the self weight-induced flow-in of the developer when the developer is supplied to the recess portion via the discharging opening. Namely, the regulating member diverts the flow path of the developer that is to pass through the discharging opening, and a resisting force is exerted against the load of the gravity on the developer. This prevents the self weight-induced flow-in of the developer, i.e., prevents the developer from directly flowing into the recess portion. Accordingly, even when a good deal of the developer is contained in the container main body, the self weight-induced flow-in is prevented from causing a large amount of the developer to the recess portion. Therefore, the regulating member ensures that the developer is evenly supplied from the developer container to the developing section irrespective of how much developer is left in the developer container. This can improve an image quality during the image forming.

Further, the image forming apparatus of the present invention includes: (i) a developer container, configured to be detachably provided to contain a developer for use in an image formation; and (ii) a developing section for developing an image with the use of the developer supplied from the developer container.

According to the arrangement, the developer container allows the developer to be stably supplied to the developing section, irrespective of how much developer is left in the developer container. This prevents blocking and puncturing due to agglomeration of the developer. On this account, an image quality can be improved.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6(*b*) is a right side view illustrating the container main body shown in FIG. 5.

FIG. 7(*b*) is a perspective view illustrating a third container portion of another embodiment of the present invention.

FIG. 9(*b*) is a cross sectional view illustrating the third container portion (shown in FIG. 1), which is taken along a line S92—S92 of FIG. 8.

FIG. 14(*b*) is a cross sectional view illustrating the sealing member taken perpendicular to its outer peripheral surface.

FIG. 24(*b*) is a schematic diagram illustrating a flow of a toner in a third container portion that includes the regulating member.

DESCRIPTION OF THE EMBODIMENTS

The following description deals with one embodiment of the present invention, however, the present invention is not limited to this. The present embodiment exemplifies a developer container such as a toner cartridge, the developer container being detachably provided in an image forming apparatus of electro-photographical type.

Figure 2:
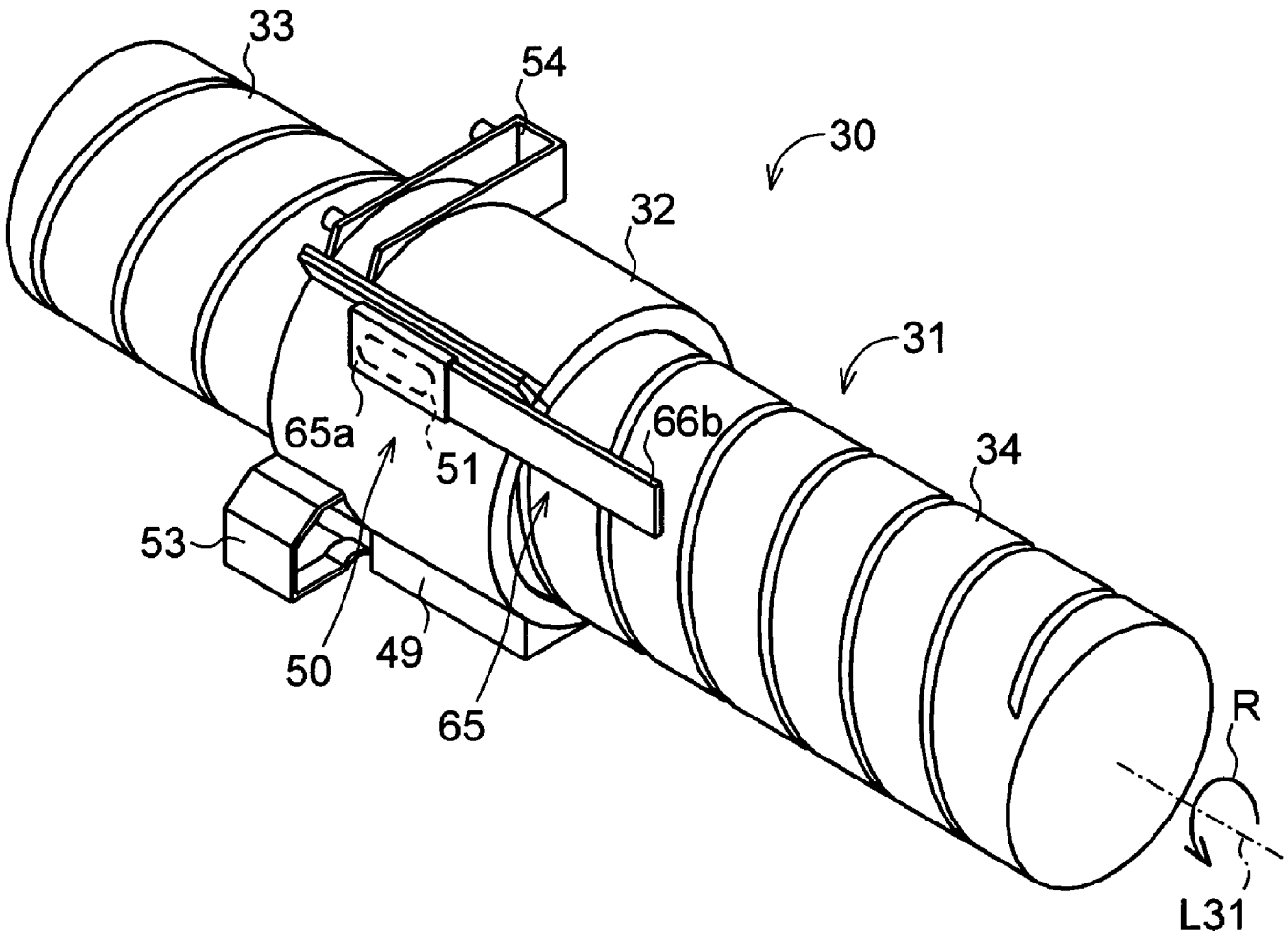
FIG. 2 is a perspective view illustrating the developer container of one embodiment of the present invention.
Figure 3:
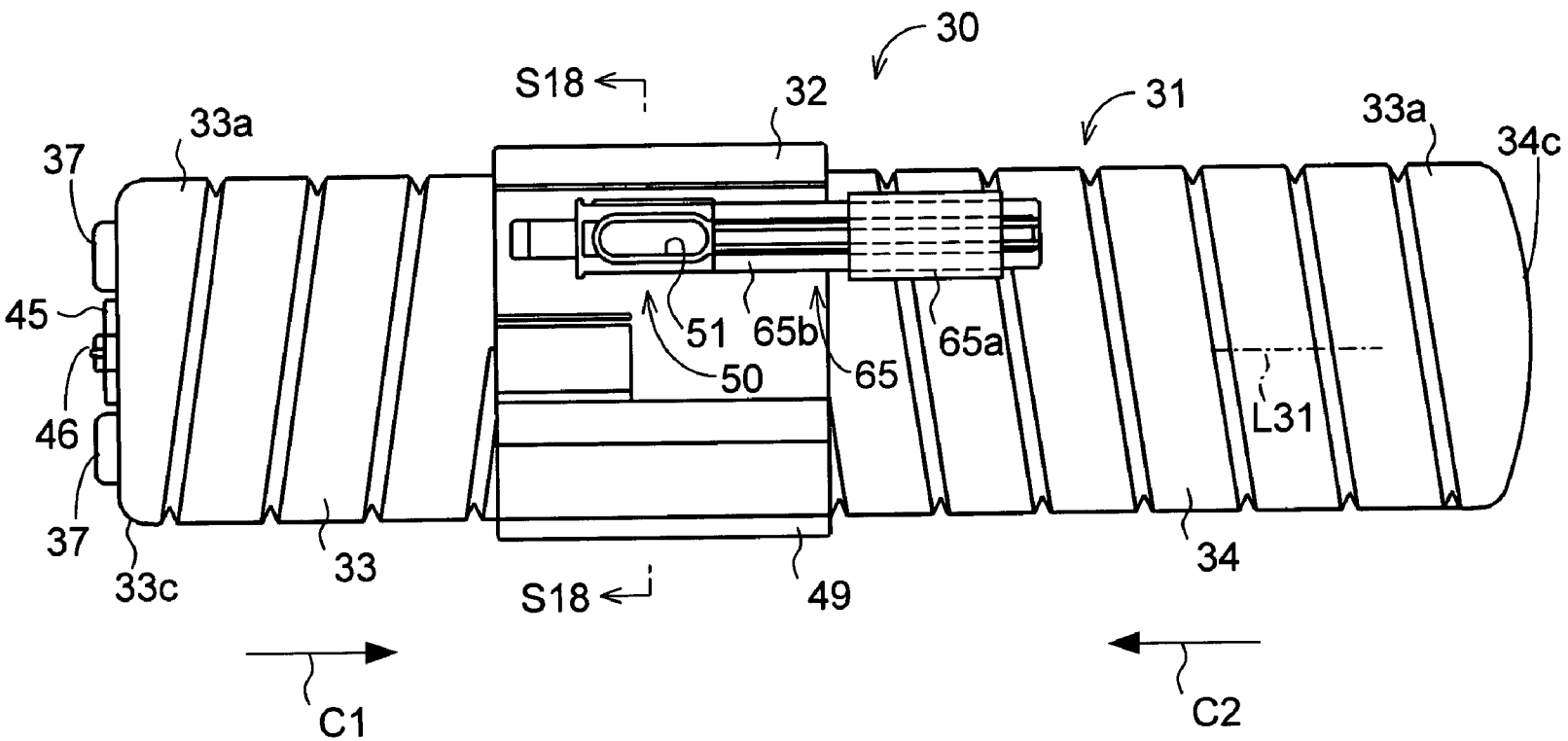
FIG. 3 is a front view illustrating the developer container shown in FIG. 2.
Figure 4:
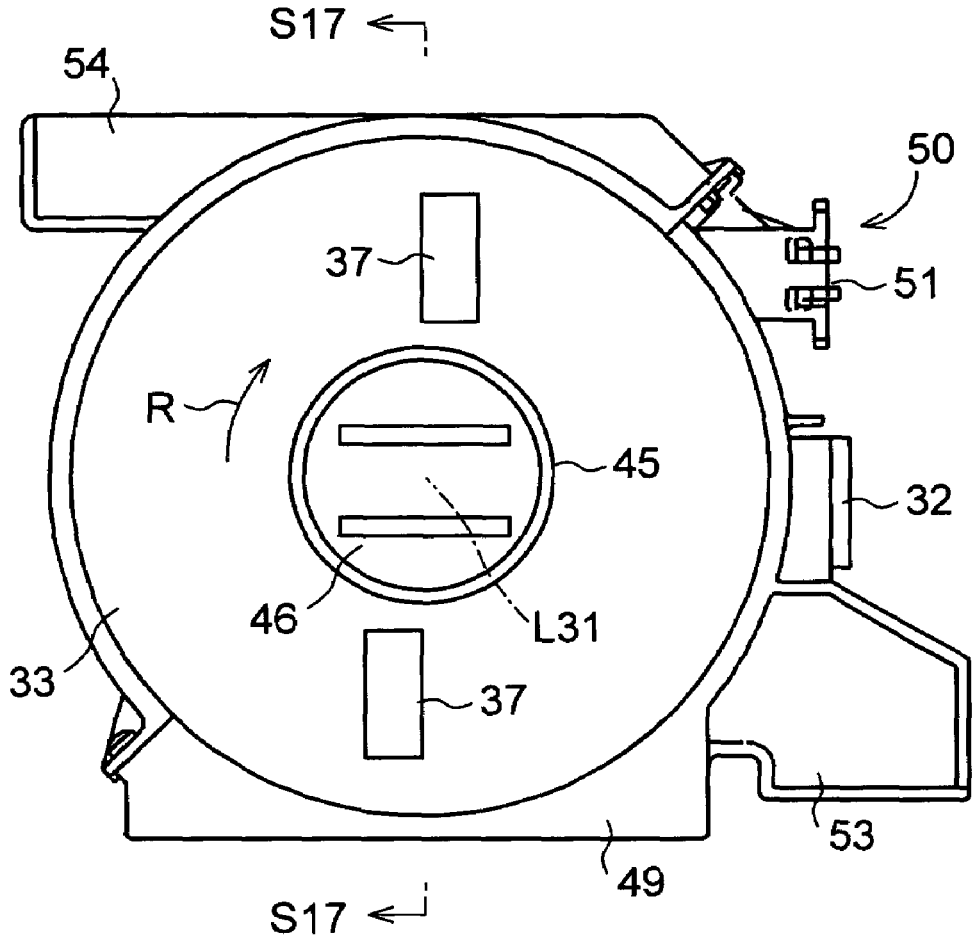
FIG. 4 is a left side view illustrating the developer container shown in FIG. 2.

FIG. 2 is a perspective view illustrating a developer container 30 of one embodiment of the present invention. FIG. 3 is a front view illustrating the developer container 30. FIG. 4 is a left side view illustrating the developer container 30. The developer container 30 includes a container main body 31 and a supporting member 32. The container main body 31 has a substantially cylindrical shape, and is used for containing a developer, such as toner, for an electro-photographical image forming. The supporting member 32 supports the container main body 31 so that the container main body 31 can rotate with respect to an axis line L31 (axis of rotation) of the container main body 31. The developer container 30 can contain, for example, 1400 g of developer. Note that, hereinafter, the axis line L31 of the container main body 31 is also described as "rotation axis line L31."

Figure 5:
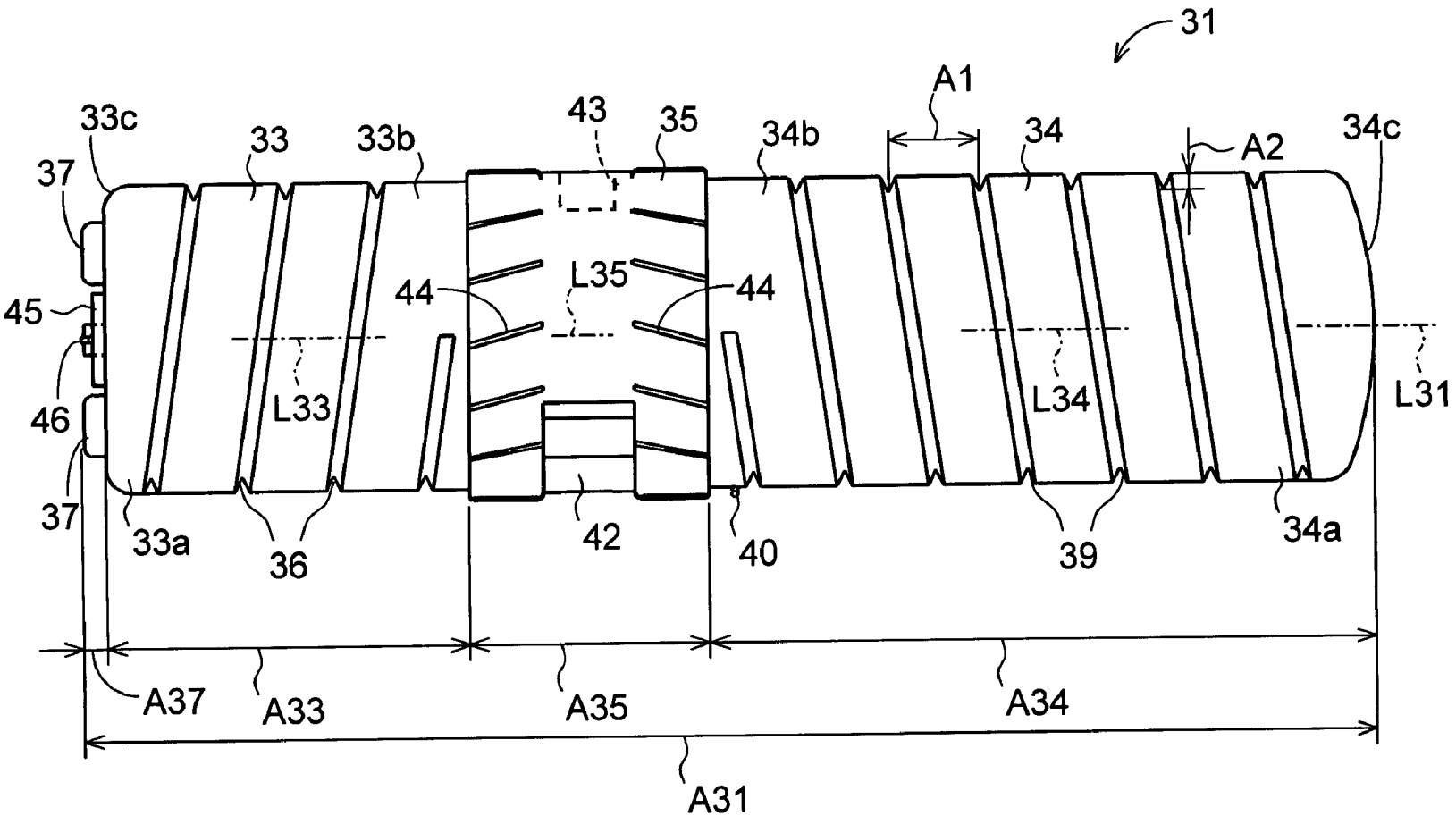
FIG. 5 is a front view illustrating a container main body of the developer container shown in FIG. 2.
Figure 6:
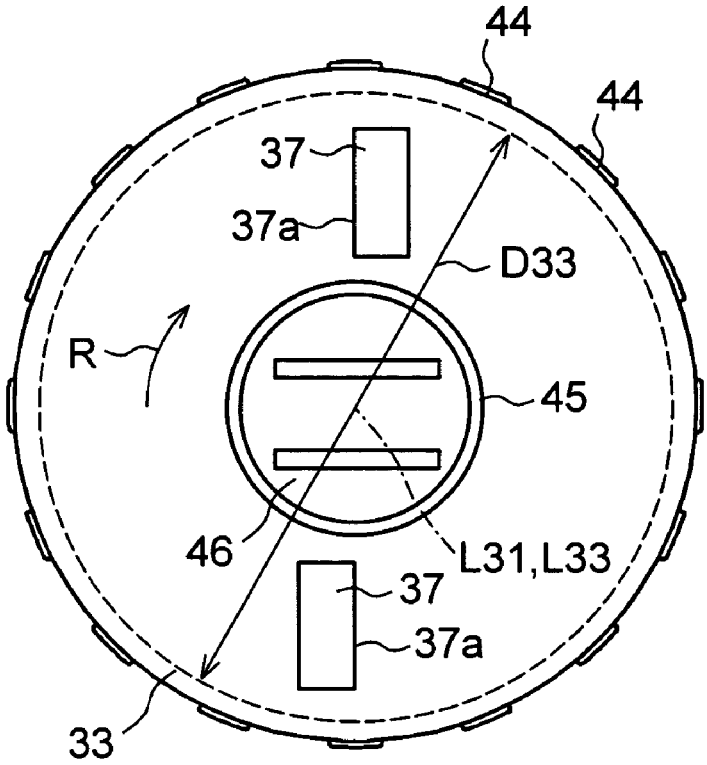
FIG. 6(*a*) is a left side view illustrating the container main body shown in FIG. 5.
Figure 6:
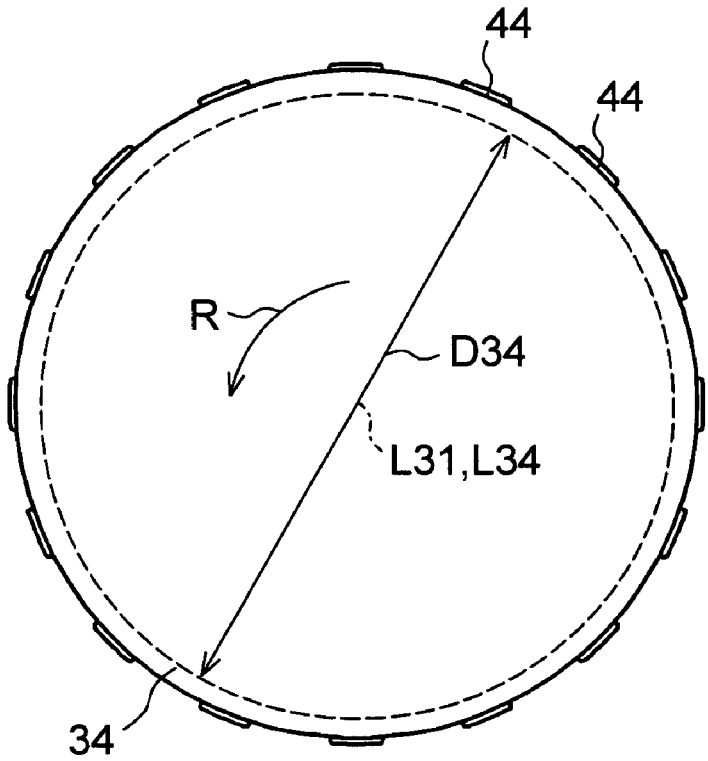

FIG. 5 is a front view illustrating the container main body 31. FIG. 6(*a*) is a left side view illustrating the container main body 31. FIG. 6(*b*) is a right side view illustrating the container main body 31. The container main body 31 includes a first container portion 33, a second container portion 34, and a third container portion 35. The container main body 31 may have a length A31 of, for example, 200 mm to 550 mm along the axis line L31.

The first container portion 33 has a cylindrical shape having a closed end. The first container portion 33 may have a length A33 of, for example, 50 mm to 250 mm along an axis line L33. As shown in FIG. 5, the first container 33 has a first protruding ledge 36 in its inner peripheral surface. The first protruding ledge 36 inwardly protrudes in a radial direction of the first container portion 33, and spirally extends from a closed end portion 33*a* to an aperture end portion 33*b*, the closed end portion 33*a* being a first end portion of the first container portion 33 in the axis line L33, and the aperture end portion 33*b* being a second end portion of the first container portion 33 in the axis line L33. Specifically, when seen from the closed end portion 33*a* of the first container portion 33, the first protruding ledge 36 spirally extends from the bottom portion 33*a* to the aperture end portion 33*b* so that the first protruding ledge 36 rotates counterclockwise, along the inner peripheral surface of the first container portion 33, with respect to the axis line L33.

As shown in FIG. 5 and FIG. 6(*a*), on the closed end portion 33*a*, a plurality of (two in the present embodiment) fit-in rise portions 37 and a refill opening 45 are provided. The fit-in rise portions 37 outwardly protrude from the closed end portion 33*a* in a direction from the aperture end portion 33*b* to the closed end portion 33*a*, and serve as connecting portions. The refill opening 45 is formed on a central portion of the closed end portion 33*a* of the first container portion 33, and penetrates the closed end portion 33*a* in a direction along the rotation axis line L31. The refill opening 45 has a circular shape whose center is coincident with the axis line L33 of the first container portion 33. The refill opening 45 is sealed by a detachable refill cover 46 in such a manner that the refill cover 46 is not detached by a rotation of the container main body 31. The refill cover 46 has a shape that corresponds to the shape of the refill opening 45. When the refill cover 46 is detached from the refill opening 45, an inside of the container main body 31 is connected to an outside thereof, thereby allowing the container main body 31 to be refilled with a developer.

Specifically, the fit-in rise portions 37 are symmetrically provided and positioned outwardly from the refill opening 45 in the radial direction of the first container portion 33, with respect to the axis line L33 of the first container portion 33. More specifically, as shown in FIG. 6(*a*), the fit-in rise portions 37 each have upstream side surfaces 37*a*, which is formed in upstream of a rotation direction R. The rotation direction R is a clockwise rotation direction with respect to the rotation axis line L31 when seen from the closed end portion 33*a* of the first container portion 33. The upstream side surfaces 37*a* are flat surfaces that extend perpendicularly to the rotation direction R, respectively. Further, the fit-in rise portions 37 have slopes that decline, in the direction of the second end portion, from the upstream side surfaces 37*a* to their downstream side surfaces, respectively. The fit-in rise portions 37 may each have a protruding amount A37 of, for example, 5 mm to 20 mm from the bottom portion 33*a* in the direction along the axis line L33. The fit-in rise portions 37 are detachably attached to a main body connecting portion (not shown) of an image forming apparatus 70 (described later).

The closed end portion 33*a* of the first container portion 33 has an outer peripheral surface (side surface), a terminal surface (end surface), and a surface (bevel surface) 33*c* which is formed between them. As shown in FIG. 5, the surface 33*c* curves inwardly, in the radial direction of the first container portion 33, from the outer peripheral surface to the terminal surface.

The second container portion 34 has a cylindrical shape having a closed end. The second container portion 34 may have a length A34 of, for example, 100 mm to 300 mm along an axis line L34. As shown in FIG. 5, the second container 34 has a second protruding ledge 39 on its inner peripheral surface. The second protruding ledge 39 inwardly protrudes in a radial direction of the second container 34, and spirally extends from a closed end portion 34*a* to an aperture end portion 34*b*. The closed end portion 34*a* is a first end portion of the second container portion 34 in the axis line L34, and the aperture end portion 34*b* is a second end portion of the second container portion 34 in the axis line L34. Specifically, when seen from the closed end portion 34*a* of the second container portion 34, the second protruding ledge 39 spirally extends from the closed end portion 34*a* to the aperture end portion 34*b* so that the second protruding ledge 39 rotates clockwise, along the inner peripheral surface of the second container portion 34, with respect to the axis line L34. Namely, the second protruding ledge 39 rotates inversely to the first protruding ledge 36. The first protruding ledge 36 of the first container portion 33 and the second protruding ledge 39 of the second container portion 34 may have a pitch A1 of, for example, 20 mm to 40 mm, respectively. Further, the first protruding ledge 36 and the second protruding ledge 39 may each have a protruding amount A2 of 3 mm to 10 mm from that portion of the inner peripheral surface which the first protruding ledge 36 or the second protruding ledge 39 is not formed.

The closed end portion 34*a* of the second container portion 34 has an outer peripheral surface (side surface), a terminal surface (end surface) 34*c*, and a surface (bevel surface) which is formed between them. The surface formed therebetween curves inwardly, in the radial direction of the second container portion 34, from the outer peripheral surface to the terminal surface 34*c*. Further, the terminal surface 34*c* of the closed end portion 34*a* has a partially globe shape whose central portion protrudes outwardly in a direction along the axis line L34. Further, a plurality of (two in the present embodiment) guiding protruding slips 40 are provided, and positioned with a certain space from a terminal surface of the aperture end portion 34*b*, on an outer peripheral surface of the aperture end portion 34*b*. Further, the guiding protruding slips 40 outwardly protrude in the radial direction of the second container portion 34, respectively. The guiding protruding slips 40 may have a length of, for example, 2 mm to 6 mm along the axis line L34, respectively.

The length A34 of the second container portion 34 is longer than the length A33 of the first container portion 33, and may be 30 mm or further longer than the length A33. For example, the length A33 of the first container portion 33 is 150 mm, and the length A34 of the second container portion is 215 mm. Further, the first container portion has a bore diameter D33 excluding the first protruding ledge 36, and the second container portion has a bore diameter D34 excluding the second protruding ledge 39. The bore diameters D33 and D34 may be in a range of 30 mm to 200 mm.

Figure 1:
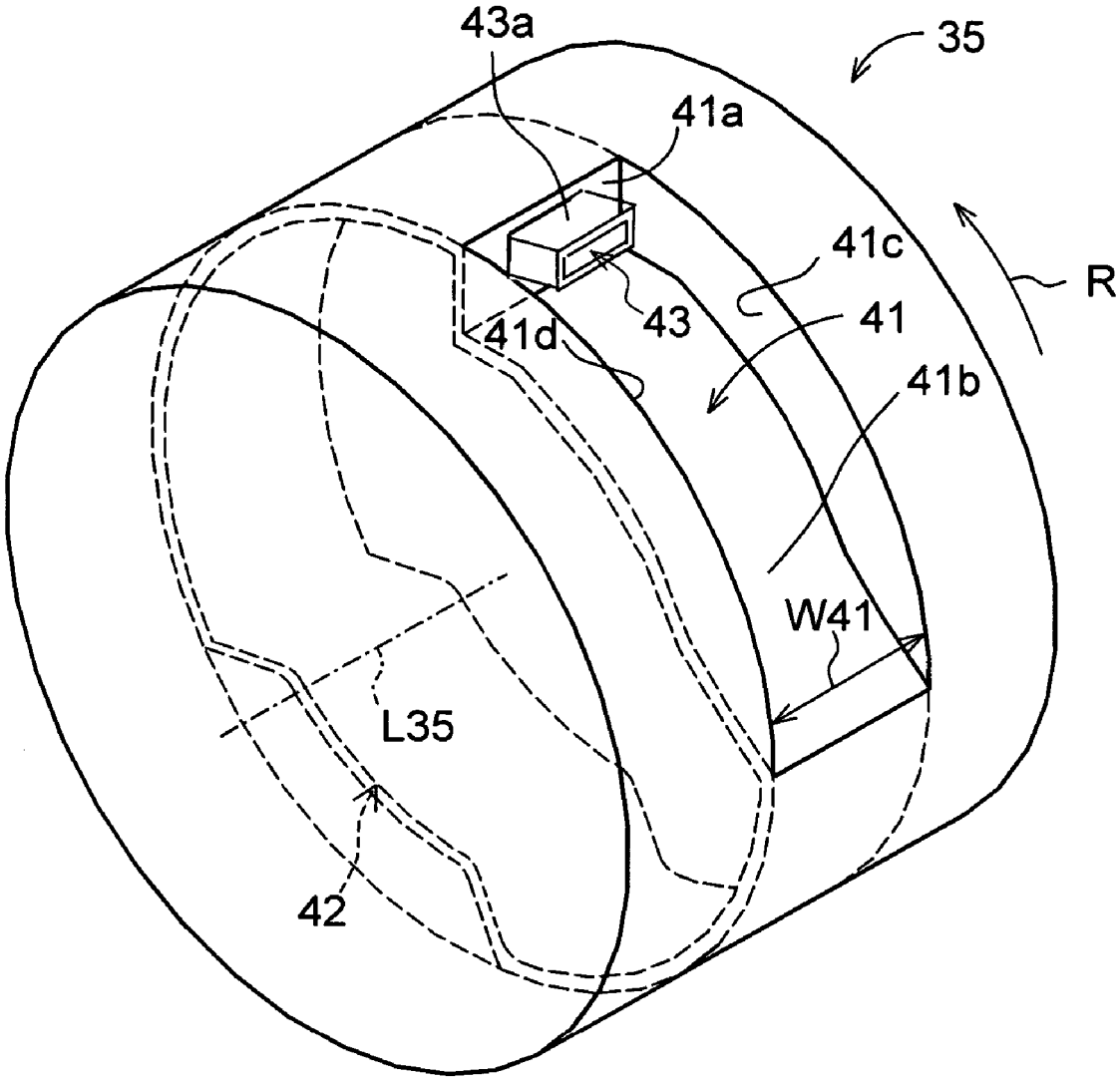
FIG. 1 is a perspective view illustrating a third container portion of a developer container of one embodiment of the present invention.
Figure 8:
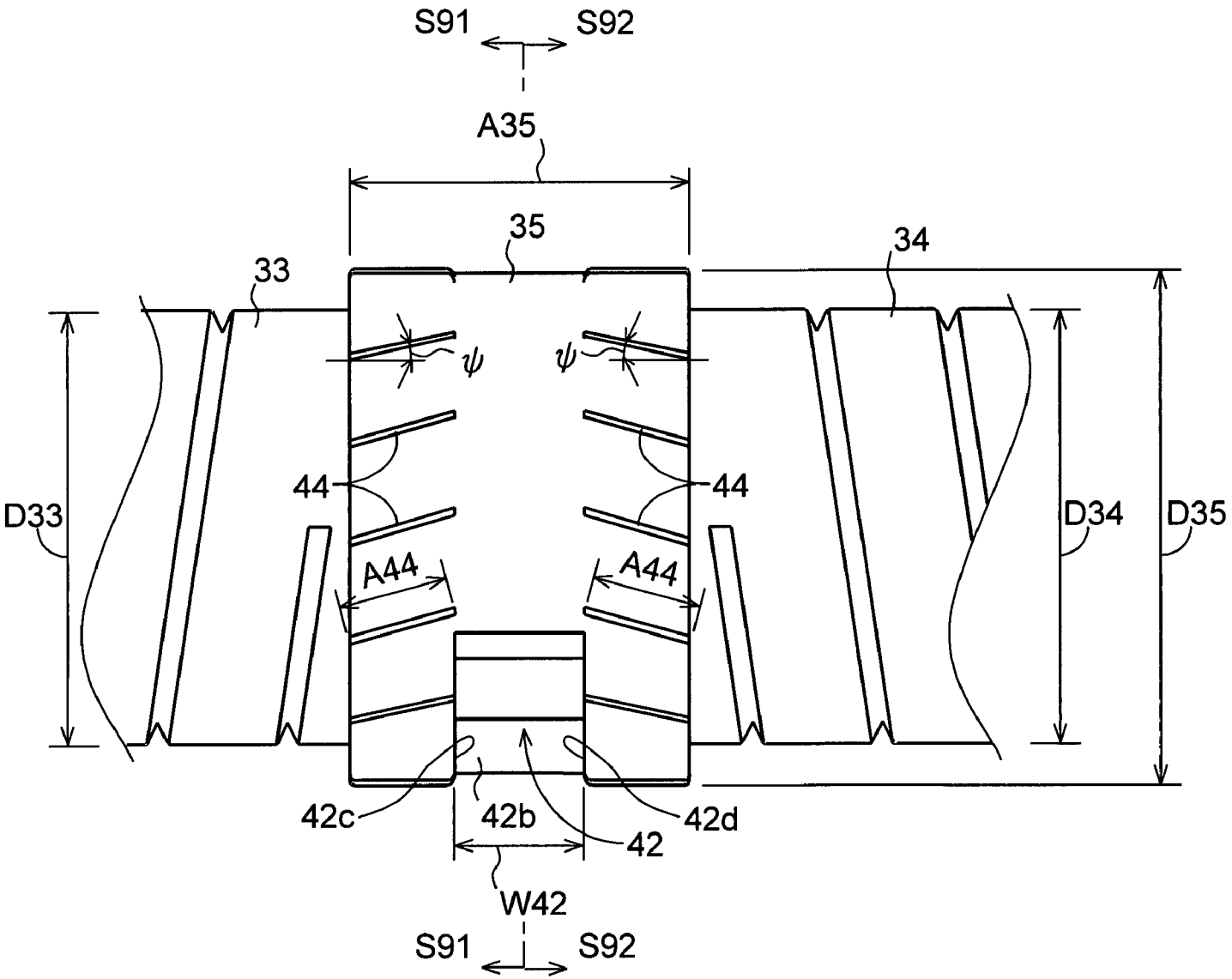
FIG. 8 is an enlarged front view illustrating a vicinity of the third container portion of the developer container shown in FIG. 2.
Figure 9:
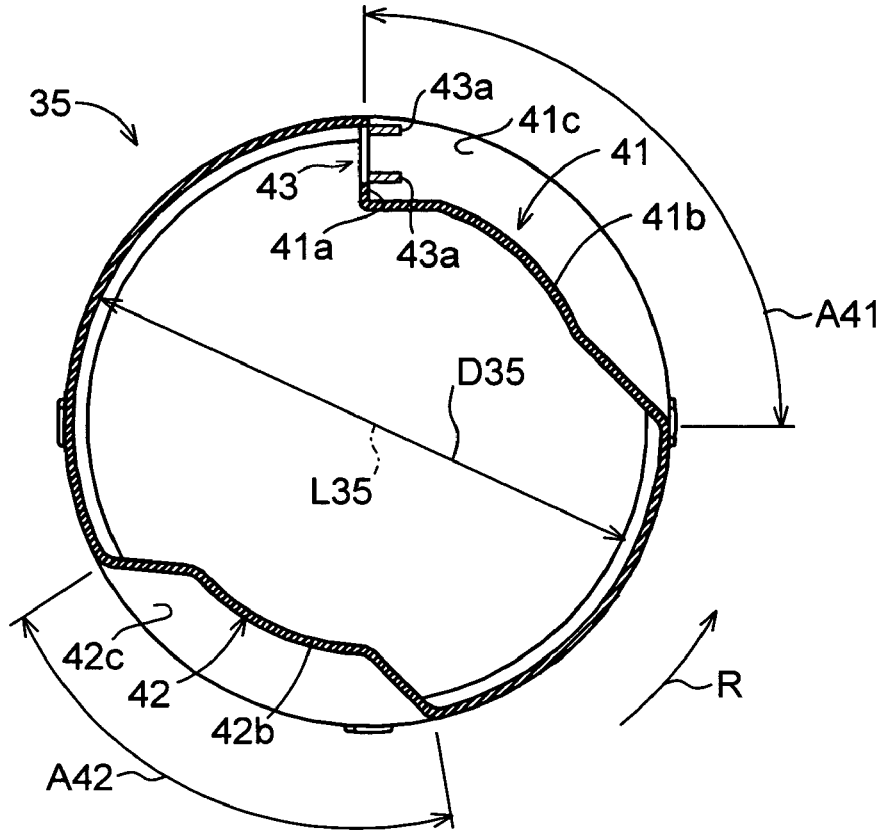
FIG. 9(*a*) is a cross sectional view illustrating the third container portion (shown in FIG. 1), which is taken along a line S91—S91 of FIG. 8.
Figure 9:
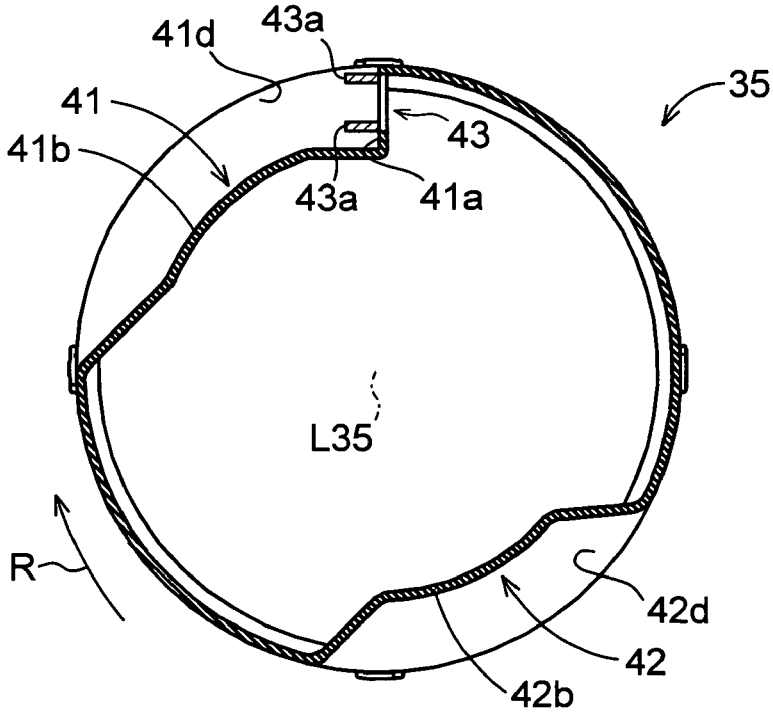

FIG. 1 is a perspective view illustrating the third container portion 35. FIG. 8 is an enlarged front view illustrating a vicinity of the third container portion 35. FIG. 9(*a*) is a cross sectional view taken along line S91—S91 of FIG. 8. FIG. 9(*b*) is a cross sectional view taken along line S92—S92 of FIG. 8.

As shown in FIG. 1, the third container portion 35 has substantially cylindrical shape. Specifically, the third container portion 35 includes a first recess portion (recess portion) 41 on its outer peripheral surface. Location of the first recess portion is a central portion of the outer peripheral surface of the third container portion 35 in an axis line L35. The first recess portion 41 depresses inwardly in a radial direction of the third container portion 35. The third container portion 35 further includes a second recess portion 42 at a location on its outer peripheral surface which is a certain distance away from the first recess portion 41. Further, in the first recess portion 41, a discharging opening 43 is provided to discharge the developer. Note that the third container portion 35 rotates with respect to the axis line L35. Note also that the discharging opening 43 is formed so as to discharge toner upstream of the rotation direction R of the third container portion 35 into the downstream end of the first recess portion 41. The third container portion 35 may have a length A35 of, for example, 50 mm to 150 mm along the axis line L35. The third container portion 35 has a bore diameter D35 larger than the respective bore diameters D33 and D34 of the first container portion 33 and the second container portion 34, the bore diameter D35 excluding the first recess portion 41 and the second recess portion 42. The bore diameter D35 may be in a range of, for example, 32 mm to 205 mm.

Here, detail description about shapes of the first recess portion 41 and the second recess portion 42 is made. The first recess portion 41 extends along the rotation direction R. The first recess portion 41 has a length A41 (shown in FIG. 9(*a*)) along the rotation direction R, and has a width W41 (shown in FIG. 1) along the axis line L35. The length A41 is longer than the width W41. Further, the first recess portion 41 includes a terminal wall (end wall) 41*a* formed on a downstream end, thereof with respect to the rotation direction R. The terminal wall 41*a* has a surface orthogonal to the rotation direction R. The discharging opening 43 is formed on a portion of the terminal wall 41*a*.

The second recess portion 42 extends along the rotation direction R. The second recess portion 42 has a length A42 along the rotation direction R, and has a width W42 along the axis line L35. The length A42 is longer than the width W42. The second recess portion 42 is formed, on the outer peripheral surface of the third container portion 35, at a certain distant away from the first recess portion 41. It is preferable that the second recess portion 42 be so formed that the second recess portion 42 faces the first recess portion 41 with respect to the axis line L35 (i.e., diametrically opposed). The length A41 of the first recess portion 41 is preferably as large as ¼ or greater of the outer peripheral surface of the third container portion 35, and is preferably smaller than ½ thereof, the outer peripheral surface excluding the first recess portion 41 and the second recess portion 42. Specifically, the length A41 of the first recess portion 41 is preferably in a range of 20 mm to 150 mm, and the width W41 thereof is preferably in a range of 20 mm to 150 mm. Further, the length A42 of the second recess portion 42 is preferably 20 mm to 150 mm, and the width W42 thereof is preferably 20 mm to 80 mm.

Further, as shown in FIG. 1, the first recess portion 41 includes a bottom wall 41*b*, the first side wall 41*c*, and the second side wall 41*d*. The bottom wall 41*b* of the first recess portion 41 extends along the rotation direction R. Firstly, the bottom wall 41*b* has a downstream end, with respect to the rotation direction R. The downstream end of the bottom wall 41*b* is connected to a radial inner end of the terminal wall 41*a*, the radial inner end being one end positioned inwardly in the radial direction of the third container portion 35. Further, the bottom wall 41*b* has an upstream end, which is upstream with respect to the rotation direction R. The upstream end of the bottom wall 41*b* is connected to that part of the outer peripheral surface of the third container portion 35 which is between the first recess portion 41 and the second recess portion 42. They are connected to each other in such a manner that the upstream end of the bottom wall 41*b* and the part of the outer peripheral surface form an obtuse angle. Between the downstream end of the bottom wall 41*b* and the upstream end thereof, the bottom wall 41*b* has a central portion. The central portion is depressed inwardly, in the radial direction of the third container portion 35, from that portion of the outer peripheral surface of the third container portion 35 which excludes the first recess portion 41 and the second recess portion 42. The central portion has a substantially partially cylindrical shape whose axis is the axis line L35 of the third container portion 35. The central portion of the bottom portion 41*b* of the first recess portion 41 has a surface preferably having a curvature radius of, for example, 10 mm to 90 mm.

Next, the first side wall 41*c* of the first recess portion 41 is a first end portion of the first recess portion 41, the first end portion being one end portion in a direction along the axis line L35. The first side wall 41*c* extends along the rotation direction R. The first side wall 41*c* has a downstream end, with respect to the rotation direction R. The downstream end of the first side wall 41*c* is connected to a first end of the terminal wall 41*a*, the first end being one end in a direction along the axis line L35. Further, the first side wall 41*c* has a radial inner end, which is one end positioned inwardly in the radial direction of the third container portion 35. The radial inner end of the first side wall 41*c* is connected to a first end of the bottom wall 41*b*, the first end being one end in a direction along the axis line L35. Furthermore, the first side wall 41*c* has a radial outer end, which is the other end positioned outwardly in the radial direction of the third container portion 35. The radial outer end of the first side wall 41*c* is connected to that outer peripheral surface of the third container portion 35 which excludes the first recess portion 41 and the second recess portion 42. Next, the second side wall 41*d* of the first recess portion 41 is a second end portion of the first recess portion 41, the second end being the other end portion in a direction along the axis line L35. The second side wall 41*d* extends along the rotation direction R. The second side wall 41*d* has a downstream end, downstream with respect to the rotation direction R. The downstream end of the second side wall 41*d* is connected to a second end of the terminal wall 41*a*, the second end being the other end in a direction along the axis line L35. Further, the second side wall 41*d* has a radial inner end, which is one end positioned inwardly in the radial direction of the third container portion 35. The radial inner end of the second side wall 41*d* is connected to the second end of the bottom wall 41*b*. Furthermore, the second side wall 41*d* has a radial outer end, which is the other end positioned outwardly in the radial direction of the third container portion 35. The radial outer end of the second side wall 41*d* is connected to that outer peripheral surface of the third container portion 35 which excludes the first recess portion 41 and the second recess portion 42. When seen from the bottom wall 41*b*, the first wall 41*c* and the second wall 41*d* extend outwardly, in the radial direction of the third container portion 35, from the bottom wall 41*b*. The bottom wall 41*b* is perpendicular to the first side wall 41*c*, and to the second side wall 41*d*.

The discharging opening 43 is provided on a central portion of the terminal wall 41*a* of the first recess portion 41, specifically, on that portion of the central portion of the terminal wall 41*a* which is located outwardly with respect to the center of the central portion in the radial direction. Further, the discharging opening 43 has a rectangular shape whose longitudinal sides are along the axis line L35. Specifically, the discharging opening 43 is located: outwardly, in the radial direction, with respect to the downstream end of the bottom wall 41*b*; and closer to the second end portion of the terminal wall 41*a* than the downstream end of the first side wall 41*c*; and closer to the first end portion of the terminal wall 41*a* than the downstream end of the second side wall 41*d*. More specifically, the discharging opening 43 has an outer radial side, which is one side disposed outwardly in the radial direction, and the outer radial side of the discharging opening 43 is connected to that inner peripheral surface of the third container portion 35 which excludes the first and the second recess portions 41 and 42.

Further, as shown in FIG. 1, a regulating member 43*a* having a tube-like shape (more specifically, square tube-like shape) is perpendicularly provided on the terminal wall 41*a* so that the regulating member 43*a* surrounds the discharging opening 43 of the first recess portion 41. The regulating member 43*a* is provided so as to regulate a discharging amount of the developer. Note that, in the present embodiment, the regulating member 43*a* is perpendicular to the terminal wall 41*a*, however, the present invention is not limited to this. The regulating member 43*a* may be formed substantially along the rotation direction of the third container portion 35 (the container main body 31) so that the regulating member 43*a* surrounds the discharging opening 43.

Figure 7:
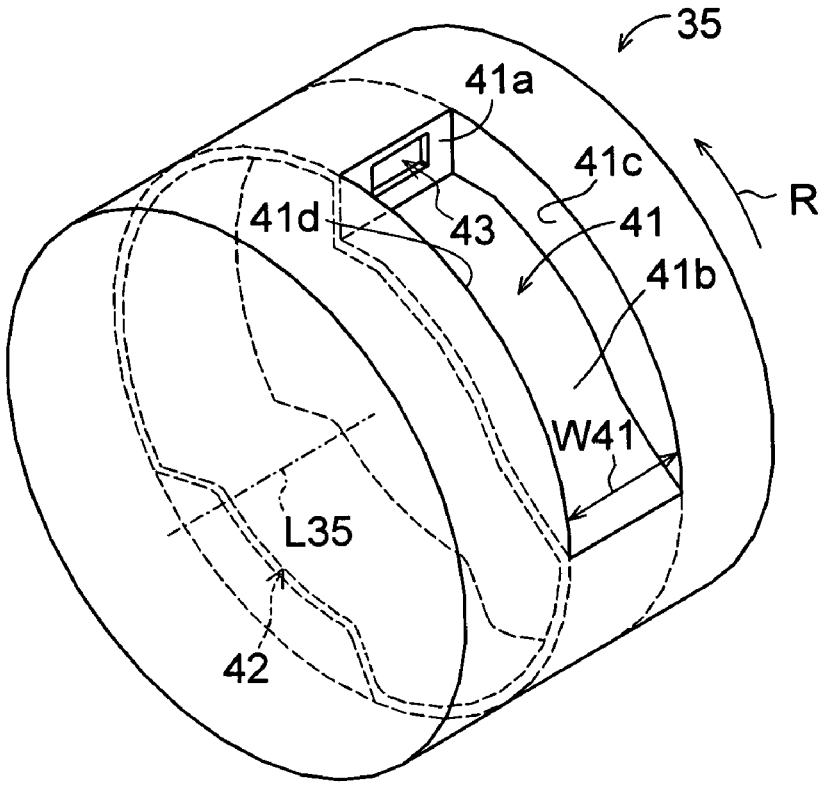
FIG. 7(*a*) is a perspective view illustrating a third container portion that does not include a regulating member.
Figure 7:
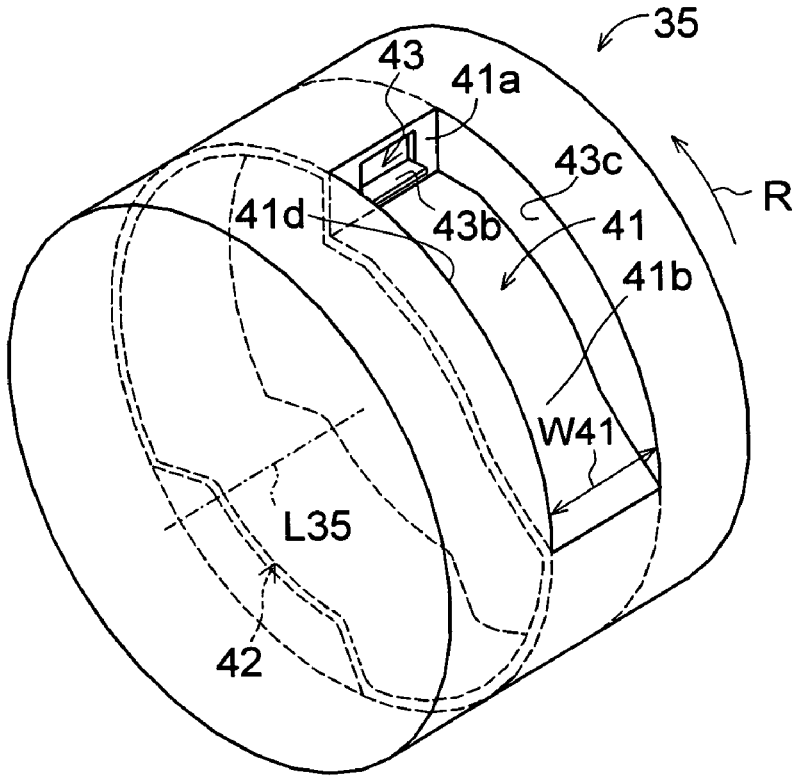

A height of the regulating member 43*a* is not particularly limited, however, the regulating member 43*a* preferably has a height of, for example, 2 mm to 10 mm from the terminal wall 41*a*. This arrangement ensures that the amount of the developer to be discharged can be more securely regulated. Further, a method for forming the regulating member 43*a* in the third container portion 35 is not particularly limited, and the regulating member 43*a* may be formed in accordance with various well-known conventional methods. For example, the third container portion 35 having no regulating member (shown in FIG. 7(*a*)) and the regulating member 43*a* having a tube-like shape are separately manufactured, and then the regulating member 43*a* is attached to the discharging opening 43 of the third container portion 35.

Figure 22:
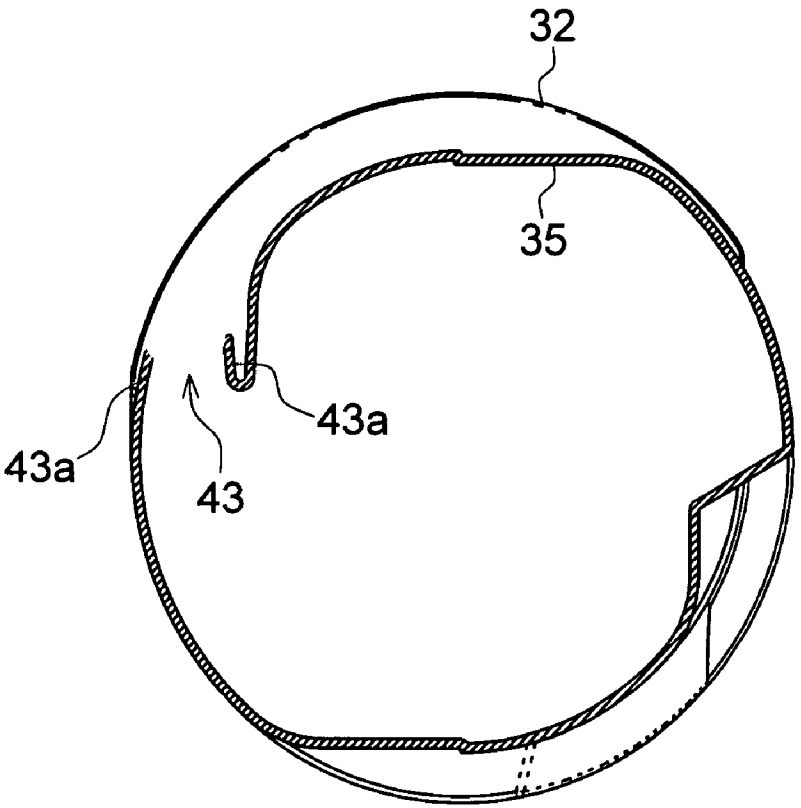
FIG. 22(*a*) and FIG. 22(*b*) illustrates how a regulating member, provided in the third container portion of the developer container of the present invention, is formed by carrying out a blow forming.
Figure 22:
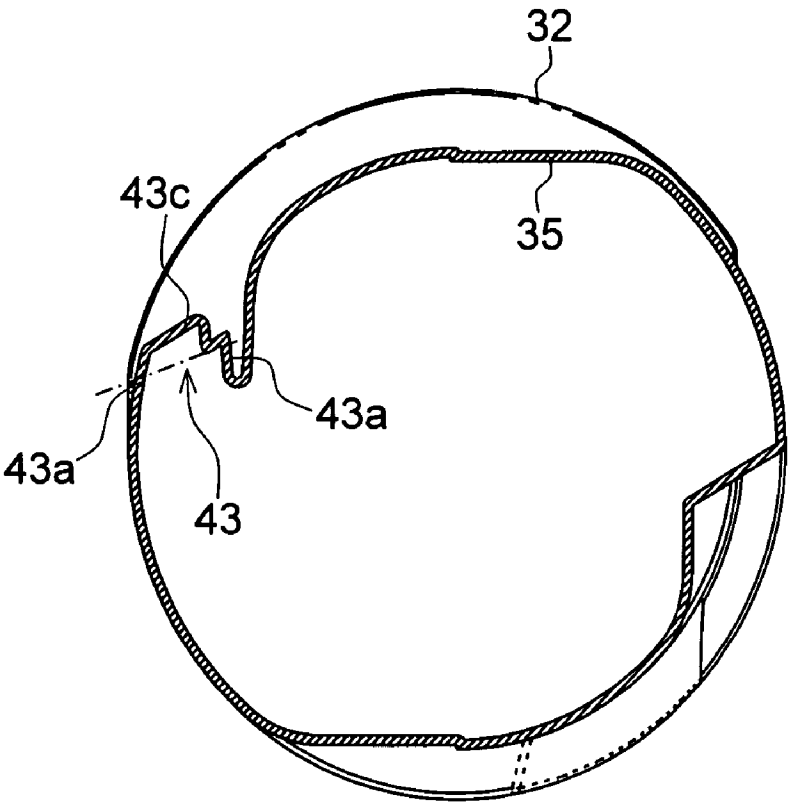

Alternatively, the third container portion 35 and the regulating member 43*a* may be fabricated in one piece by blow forming. FIG. 22(*a*) and FIG. 22(*b*) shows how the third container portion 35 is formed by blow forming. In this case, the third container portion 35 having a cylindrical shape is firstly formed so that a rise portion 43*c* is formed in its cross sectional surface as shown in FIG. 22(*a*). Then, a portion (shown in FIG. 22(*a*)) indicated by a chain line is cut off, thereby obtaining the third container portion 35 including the discharging opening 43 and the regulating member 43*a* as shown in FIG. 22(*b*).

Because the regulating member 43*a* is provided in the developer container 30 of the present embodiment, the regulating member 43*a* prevents a self weight-induced flow-in of the developer into the first recess portion 41 when the developer is discharged, via the discharging opening 43, to the first recess portion 41. A detailed description about how the regulating member 43*a* prevents the self weight-induced flow-in of the developer into the first recess portion 41 is made later.

It should be noted that the regulating member 43*a* of the present embodiment has such a shape that the developer is prevented from flowing too much, due to its gravity (weight), into the first recess portion 41, and the shape is not limited to the tube-like shape (shown in FIG. 1). The regulating member may have, for example, a plate shape such as a regulating member 43*b* (shown in FIG. 7(*b*)). The regulating member 43*b* is perpendicular to that end portion of the discharging opening 43 which is near the bottom wall 41*b* of the first recess portion 41, thereby preventing the self weight-induced flow-in of the developer into the first recess portion 41.

Specifically, the second recess portion 42 includes a bottom wall 42*b*, a first side wall 42*c*, and a second side wall 42*d*. The bottom wall 42*b* of the second recess portion 42 extends along the rotation direction R. The bottom wall 42*b* has a downstream end, downstream with respect to the rotation direction R, and has an upstream end portion, upstream with respect to the rotation direction R. The downstream end of the second recess portion 42 and the upstream end portion thereof are connected to that parts of the outer peripheral surface of the third container portion 35 which are between the first recess portion 41 and the second recess portion 42 (i.e., which excludes the first recess portion 41 and the second recess portion 42), respectively. Between the downstream end of the bottom wall 42*b* and the upstream end portion thereof, the bottom wall 42*b* has a central portion, which is along the rotation direction R. The central portion is disposed inwardly, in the radial direction of the third container portion 35, from that part of the outer peripheral surface of the third container portion 35 which excludes the first recess portion 41 and the second recess portion 42. Substantially, the central portion has a shape which is partially cylindrical with respect to the axis line L35 of the third container portion 35. The central portion of the bottom portion 42*b* of the second recess portion 42 has an outer peripheral surface preferably having a curvature radius of, for example, 10 mm to 90 mm.

The first side wall 42*c* of the second recess portion 42 is located in association with a first end portion of the second recess portion 42, the first end being one end in the direction along the axis line L35. The first side wall 42*c* extends along the rotation direction R. The first side wall 42*c* has a radial inner end, which is one end positioned inwardly in the radial direction of the third container portion 35. The radial inner end of the first side wall 42*c* is connected to a first end of the bottom wall 42*b*, the first end being one end in the direction along the axis line L35. Further, the first side wall 42*c* has a radial outer end, which is one end positioned outwardly in the radial direction. The radial outer end of the first side wall 42*c* is connected to the outer peripheral surface of the third container portion 35, the outer peripheral surface excluding the first recess portion 41 and the second recess portion 42. Next, the second side wall 42*d* of the second recess portion 42 is formed toward a second end portion of the second recess portion 42, the second end being the other end in the direction along the axis line L35. The second side wall 42*d* has a radial inner end, which is one end positioned inwardly in the radial direction of the third container portion 35. The radial inner end of the second side wall 42*d* is connected to a second end of the bottom wall 42*b*, the second end being the other end in the direction along the axis line L35. Further, the second side wall 42*d* has a radial outer end, which is one end positioned outwardly in the radial direction. The radial outer end of the second side wall 42*d* is connected to the outer peripheral surface of the third container portion 35, the outer peripheral surface excluding the first recess portion 41 and the second recess portion 42. The first wall 42*c* and the second wall 42*d* outwardly extend, in the radial direction of the third container portion 35, from the bottom wall 42*b*. The bottom wall 42*b* is perpendicular to the first side wall 42*c*, and to the second side wall 42*d*.

See FIG. 8. On that outer peripheral surfaces of the first end portion and the second end portion of the third container portion 35 which exclude the first recess portion 41 and the second recess portion 42, a plurality of discharging guides 44 are provided with intervals along the circumferential direction. Each of the discharging guides 44 provided on the first end portion of the third container 35 declines, toward the first end portion, with respect to the rotation direction R. Also, each of the discharging guides 44 provided on the second end portion of the third container portion 35 declines, toward the second end portion, with respect to the rotation direction R. The discharging guide 44 outwardly protrudes, in the radial direction of the third container portion 35, from that outer peripheral surface of the third container portion 35 which excludes the first recess portion 41 and the second recess portion 42. The discharging guide 44 may have a protruding amount of, for example, 1 mm. The discharging guide 44 has a longitudinal side whose length may be 24 mm. The discharging guide 44 and a width of the third container portion 33 may form an angle ψ of, for example, 30°.

The container main body 31 is so formed in one piece that the first end potion of the third container portion 35 and the aperture end portion 33*b* are connected to each other, and that the second end portion of the third container portion 35 and the aperture end portion 34*b* of the second container portion 34 are connected to each other. The container main body 31 may be manufactured by, for example, blow forming a synthetic resin such as polyethylene. This makes it possible to manufacture the container main body 31 with ease, and to reduce components of the developer container 30.

Therefore, the closed end portion 33*a* of the first container 33 is the first end portion 33*a* of the container main body 31, and the closed end portion 34*a* of the second container portion 34 is the second end portion 34*a* of the container main body 31. As such, the container main body 31 is so formed that the respective axis lines L33, L34, and L35 of the first container portion 33, the second container portion 34, and the third container portion 35 are coincident with one another. Further, in this state, the third container portion 35 is a central portion of the container main body 31 along the axis line L31, (axis of rotation), i.e., is disposed between the first and the second ends portion 33*a* and 34*a* of the container main body 31. Therefore, the first recess portion 41, the second recess portion 42, and the discharging opening 43 of the third container portion 35 are disposed in the central portion of the container main body 31, i.e., are disposed between the first and the second ends portion 33*a* and 34*a* of the container main body 31. Further, the axis line L31 (axis of rotation) of the container main body 31 is constituted of the respective axis lines L33, L34, and L35 of the first container portion 33, the second container portion 34, and the third container portion 35.

Figure 10:
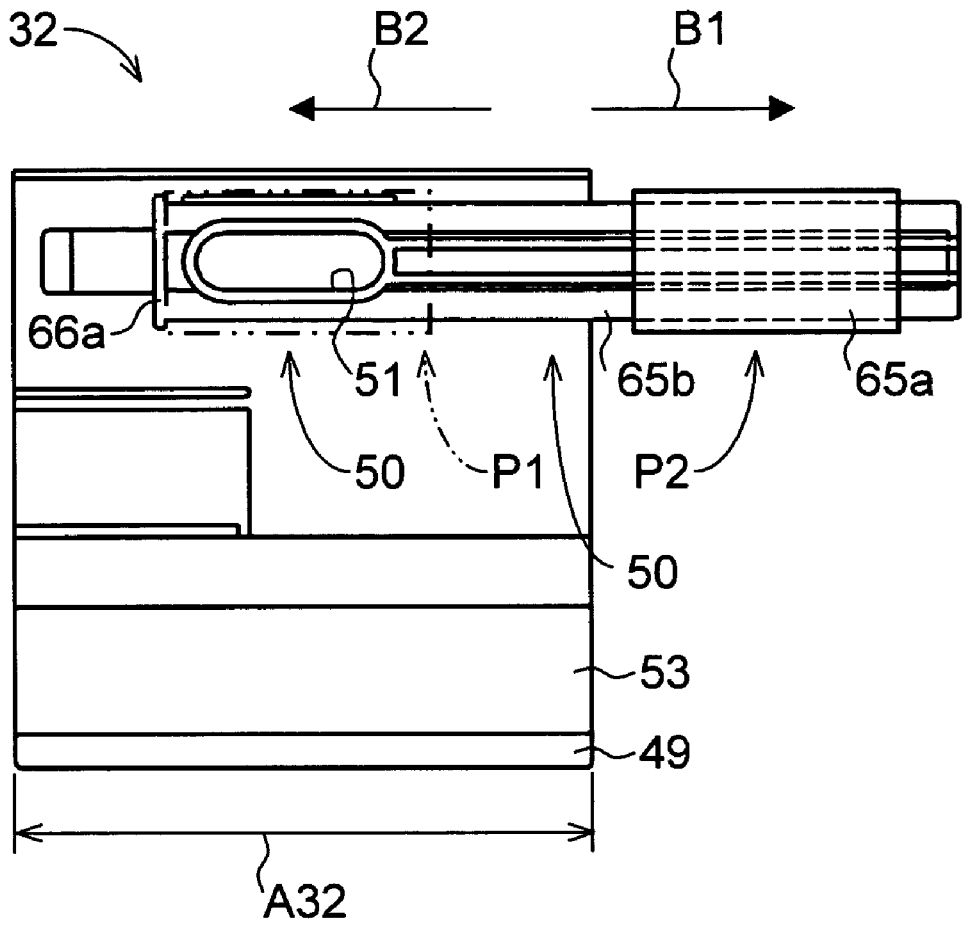
FIG. 10 is a front view illustrating a supporting member of the developer container (shown in FIG. 2).
Figure 11:
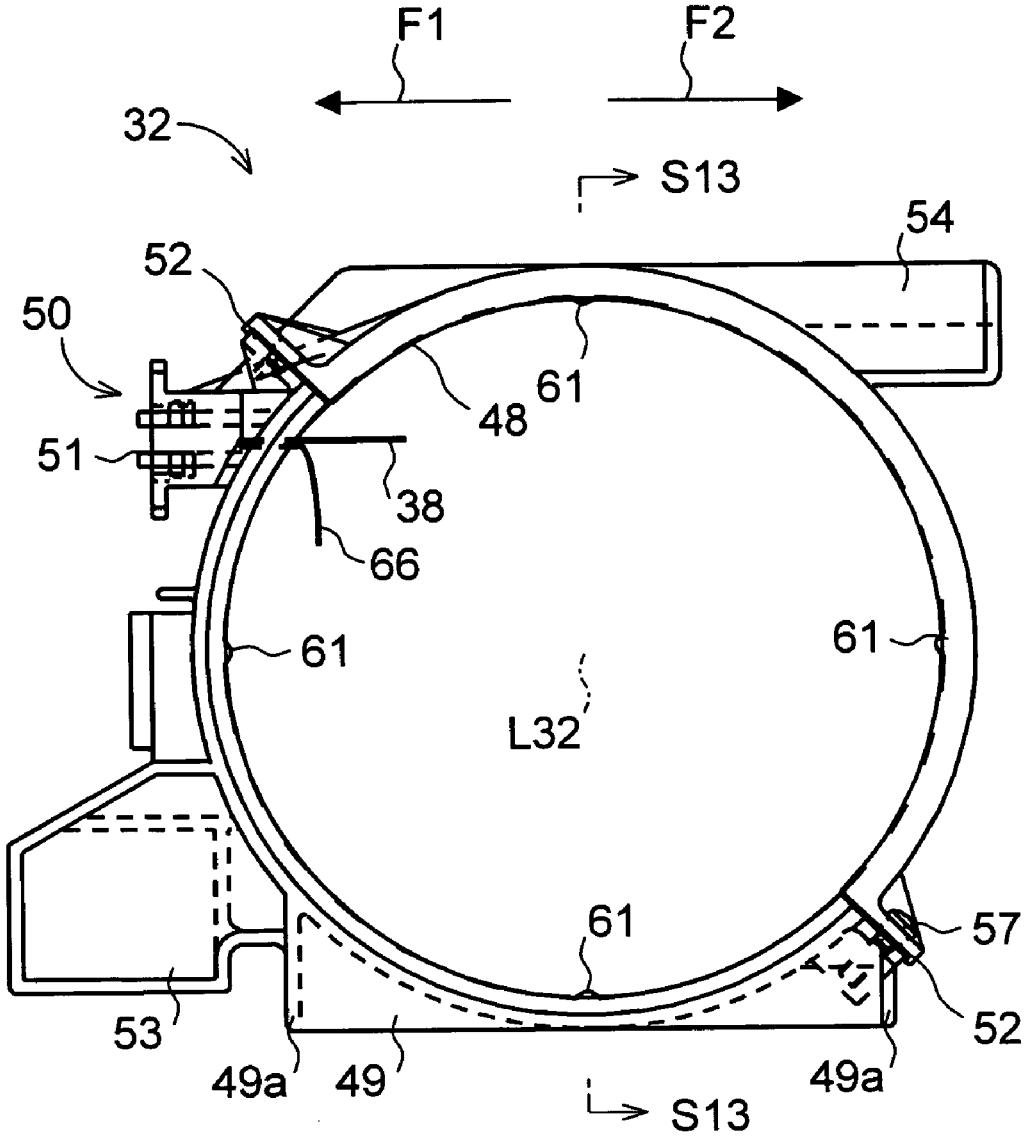
FIG. 11 is a right side view illustrating the supporting member of FIG. 10.

FIG. 10 is a front view illustrating the supporting member 32. FIG. 11 is a right side view illustrating the supporting member 32. The supporting member 32 has a substantially cylindrical shape, and includes an inner peripheral surface 48 for supporting, by wholly covering the outer peripheral surface of the third container portion 35, at least the third container portion 35 of the container main body 31 having the aforementioned structure. The inner peripheral surface 48 is a cylindrical inner peripheral surface whose center is an axis line L32. The supporting member 32 further includes a supporting board 49 having abutment portions 49*a*. The abutment portions 49*a* of the supporting board 49 may be provided, for example, on two flat surfaces of the supporting board 49, the two flat surfaces having a rectangular shape whose longitudinal sides are parallel to the axis line L32. By abutting the abutment portions 49*a* of the supporting board 49 to a horizontal flat plane, an axis line L48 of the inner peripheral surface 48 of the supporting member 32 is disposed parallel to the horizontal flat plane. The supporting member 32 has a length A32 along the axis line L32, and the length A32 is longer than the length A35 of the third container portion 35. The length A32 of the supporting member 32 may be in a range of, for example, 60 mm to 170 mm.

When the supporting board 49 is thus placed on the horizontal flat surface, a discharging portion 50 is disposed on an upper portion of the supporting member 32. The discharging portion 50 protrudes in a direction F1, which is one direction of first horizontal directions. In a central portion of the discharging portion 50, a through opening (conducting opening) 51 having an oval shape is provided, the central portion being in the axis line L32. The through opening 51 penetrates the discharging portion 50 along the direction F1, and extends parallel to the axis line L32 of the supporting member 32. Further, the through opening 51 has a bore diameter in its longitudinal direction, and the bore diameter has a size which is similar to or larger than the width W41 of the first recess portion 41, and the width W42 of the second recess portion 42.

The discharging portion 50 of the supporting member 32 is provided with a shutter section 65. The shutter section 65 opens and closes that mouth of downstream end of the through opening 51 which is formed downstream of the direction F1. The shutter section 65 includes a shutter 65*a* and a shutter guide 65*b*. The shutter guide 65*b* extends in directions B1 and B2, which are second horizontal directions perpendicular to the directions F1 and F2, respectively. The shutter guide 65*b* has an upstream end portion, which is one end portion associated with upstream of the direction B1. In the upstream end portion of the shutter guide 65*b*, the through opening 51 is disposed. The shutter 65*a* is supported by the shutter guide 65 so that the shutter 65*a* can freely slide to move in the direction B1 and the direction B2, which is inverse to the direction B1.

The shutter 65*a* can slide, along the shutter guide portion 65*b*, to a closing position P1 (indicated by a chain double dashed line in FIG. 10), and to an opening position P2. When the shutter 65*a* is in the closing position P1, the through opening 51, which is formed in the downstream of the direction F1, is closed. When in the opening position P2, the through opening 51 is opened. The shutter 65*a* is prevented from sliding further, in the direction B2, from the closing position P1. Also, the shutter 65*a* is prevented from sliding further, in the direction B2, from a downstream end portion of the shutter guide 65*b*, the downstream end portion being an end associated with downstream of the direction B2. Namely, the opening position P2 is located between the closing position P1 and a downstream end portion of the shutter guide 65*b*, the downstream end portion being associated with a downstream of the direction B1. Thus, the shutter 65*a* can be located in the opening position P2 by sliding the shutter 65*a*, in the direction B1, from the closing position P1. Similarly, the shutter 65*a* can be located in the closing position P1 by sliding the shutter 65*a*, in the direction B2, from the opening position P2.

The supporting member 32 further includes a leading member 38 serving as leading means, and a sealing sheet 66 serving as sealing means. The leading member 38 is made of a polymer resin such as polyethylene terephthalate (PET), and is in the form of sheet having flexibility and elasticity. The leading member 38 has an anchorage end portion within the through opening 51, and the anchorage end portion extends, in a direction F2 (shown in FIG. 11), to that aperture end of through opening 51 which faces the inner peripheral surface 48 of the supporting member 32. The sealing sheet 66 is made of, for example, polyethylene, and is in the form of sheet having flexibility. The sealing sheet 66 has an anchorage end portion within the through opening 51, and extends, in the direction F2, to the aperture end of through opening 51. The anchorage end portion of the leading member 38 is placed on an upper surface of the anchorage end portion of the sealing sheet 66. A detailed description of the leading member 38 and the sealing sheet 66 is made later.

Further, the supporting member 32 includes two connecting protruding sections 52, which outwardly protrudes in a radial direction of the supporting member 32. One of the connecting protruding sections 52 is provided in a portion higher than the discharging portion 50 when the supporting board 49 is placed on the horizontal flat plane. The other connecting protruding section 52 is provided symmetrically to the foregoing connecting protruding section 52 with respect to the axis line L32. The supporting member 32 further includes a first guide 53. The first guide 53 is disposed below the discharging portion 50, and protrudes in the direction F1, and extends parallel to the axis line L32 when the supporting board 49 is placed on the horizontal flat plane. The supporting member 32 further includes a second guide 54. The second guide 54 is provided above the discharging portion 50, and protrudes in the direction F2, which is inverse to the direction F1, and extends parallel to the axis line L32 when the supporting board 49 is placed on the horizontal flat plane.

Figure 12:
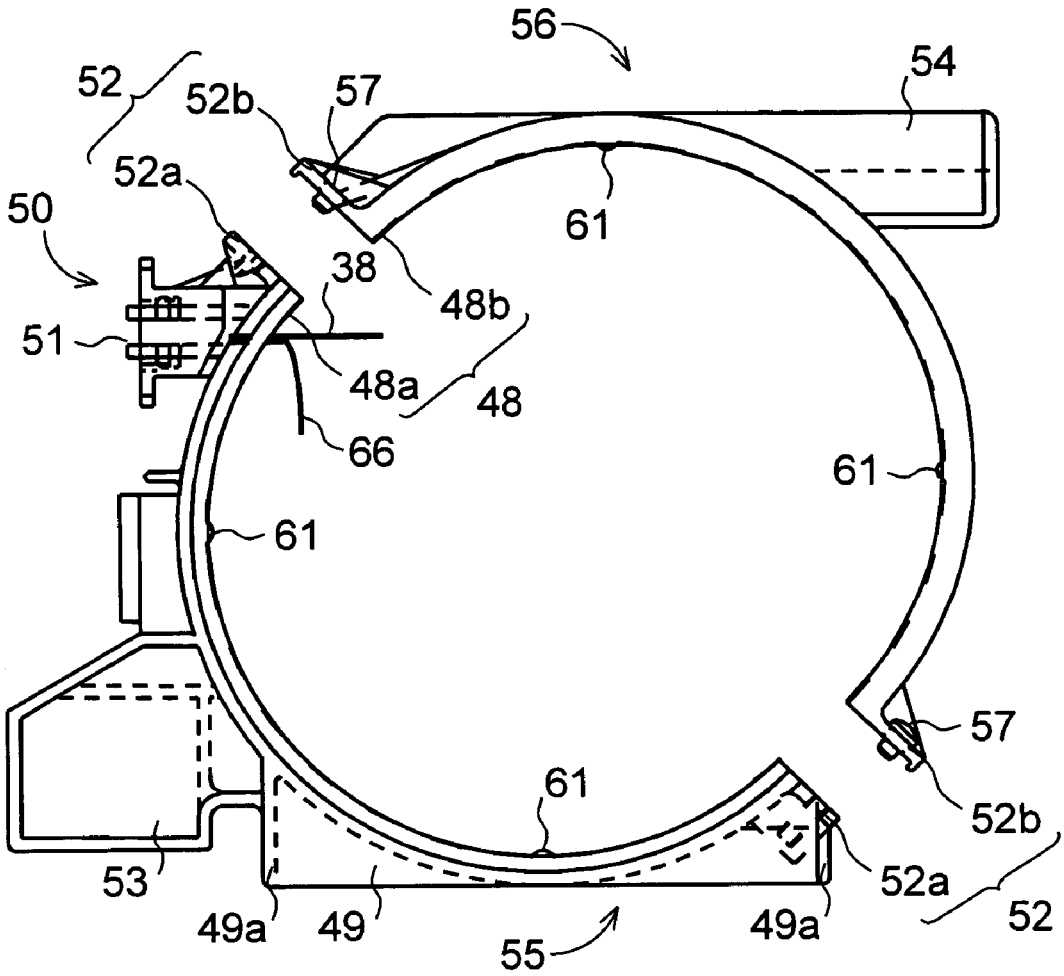
FIG. 12 is an exploded right side view illustrating the supporting member of FIG. 10.

FIG. 12 is a right side exploded diagram illustrating the supporting member 32. When the supporting member 32 is placed on the horizontal flat plane, the supporting member 32 can be divided in two with respect to an imaginary flat surface, which the axis line L32 passes and inclines in the direction F1. Specifically, the supporting member 32 can be divided into a first supporting section 55 disposed below the imaginary flat surface, and a second supporting section 56 disposed above the imaginary flat surface. Of the members included by the supporting member 32, the first supporting section 55 includes: the first guide 53, the discharging portion 50, respective halved sections 52*a* of the connecting protruding sections 52, the supporting board 49, and that section 48*a* of the inner peripheral surface 48 which is associated with the first guide 53. Of the members included by the supporting member 32, the second supporting section 56 includes: the second guide 54, respective other halved sections 52*b* of the connecting protruding sections 52, and that section 48*b* of the inner peripheral surface 48 which is associated with the second guide 54.

The first supporting section 55 and the second supporting section 56 are detachably coupled with each other by screw members 57. Specifically, the respective halved sections 52*a* of the connecting protruding portions 52 are coupled, by the screw members 57, with the respective other halved sections 52*b* thereof. Before the supporting member 32 is assembled with the container main body 31, the supporting member 32 is disassembled in advance. The supporting member 32 thus taken apart covers that portion of the container main body 31 which includes the first recess portion 41, the second recess portion 42, and the discharging opening 43. This allows the container main body 31 to be wholly supported. As such, the assembly can be carried out with ease.

Figure 13:
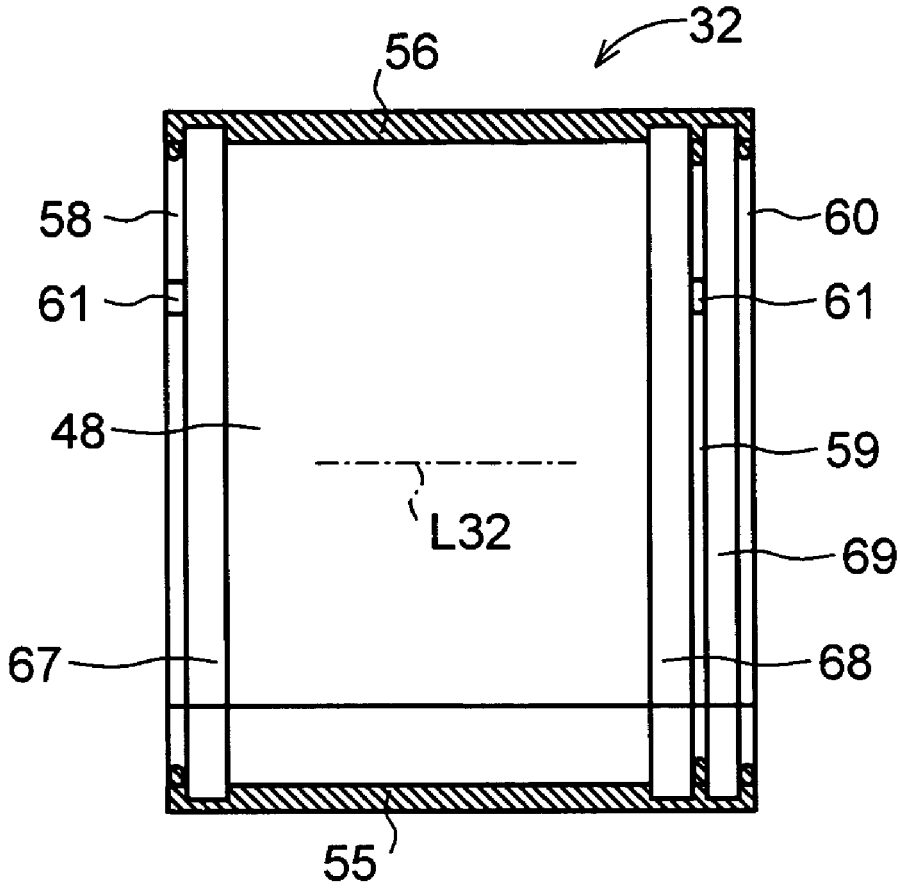
FIG. 13 is a cross sectional view illustrating the supporting member (shown in FIG. 10), which is taken along a line S13—S13 of FIG. 11.

FIG. 13 is a cross sectional view taken along a line S13—S13 (shown in FIG. 11). Hereinafter, FIG. 11 is also referred. The inner peripheral surface 48 of the supporting member 32 includes a first supporting rise portion 58 in its first end portion, which is one end portion in the axis line L32. The first supporting rise portion 58 inwardly protrudes in the radial direction of the supporting member 32, and extends entirely along the first end portion of the supporting member 32. The inner peripheral surface 48 of the supporting member 32 further includes a second supporting rise portion 59 in its second end portion, which is the other end portion in the axis line L32. The second supporting rise portion 59 inwardly protrudes in the radial direction of the supporting member 32, and extends entirely along the second end portion of the supporting member 32. Further, the inner peripheral surface 48 of the supporting member 32 further includes a third supporting rise portion 60 on the second end portion of the supporting member 32. The third supporting rise portion 60 is so located that the second end portion is closer to the third supporting rise portion 60 than the second supporting rise portion 59 is, and there is a certain space between the second and the third supporting rise portion 59 and 60. The third supporting rise portion 60 inwardly protrudes in the radial direction of the supporting member 32, and extends entirely along the second end portion. The space between the second and the third supporting rise portion 59 and 60 is a little larger than the length of the guiding protruding slip 40 of the second container portion 34 of the container main body 31, the length being along the axis line L34.

On each of the first supporting rise portions 58 and the second supporting rise portions 59, a plurality of (four, in the present embodiment) protruding supporters 61 are provided with intervals along the circumferential direction. Each of the protruding supporters 61 inwardly protrudes in the radial direction of the supporting member 32. The protruding supporter 61 has a top end portion, which is one end positioned inwardly in the radial direction. The top end portion has a supporting surface that has a curved shape that corresponds to an outer peripheral surface of semi-cylinder. Further, an imaginary circle, which passes along the top end portions of the protruding supporters 61 provided on the first and the second supporting rise portion 58 and 59, has a diameter slightly larger than an external diameter of the outer peripheral surface of the first container 33, and that external diameter of the outer peripheral surface of the second container portion 34 which excludes the guiding protruding slip 40. Further, the third supporting rise portion 60 has a bore diameter slightly larger than that external diameter of the outer peripheral surface of the second container portion 34 which excludes the guiding protruding slip 40.

Further, in the first end portion of the inner peripheral surface 48 of the supporting member 32, a first supporting recess portion 67 is provided. The first supporting recess portion 67 is adjacent to the first supporting rise portion 58, and the second end portion is closer to the first supporting recess portion 67 than the first supporting rise portion 58. The first supporting recess portion 67 depressed outwardly in the radial direction of the supporting member 32, and extends entirely along the first end portion of the inner peripheral surface 48. Further, in the second end portion of the inner peripheral surface 48 of the supporting member 32, a second supporting recess portion 68 is provided. The second supporting recess portion 68 is adjacent to the second supporting rise portion 59, and is more associated with the first end portion than the second supporting rise portion 59 is. The second supporting recess portion 68 depressed outwardly in the radial direction of the supporting member 32, and extends entirely along the second end portion of the inner peripheral surface 48. Further, in the second end portion, a third supporting recess portion 69 is provided between the second supporting rise portion 59 and the third supporting rise portion 60. The third supporting recess portion 69 depressed outwardly in the radial direction of the supporting member 32, and extends entirely along the second end portion of the inner peripheral surface 48. The third supporting recess portion 69 has a length slightly longer than the guiding protruding slip 40 of the second container portion 34 of the container main body 31, the length being along the axis line L32.

Figure 14:
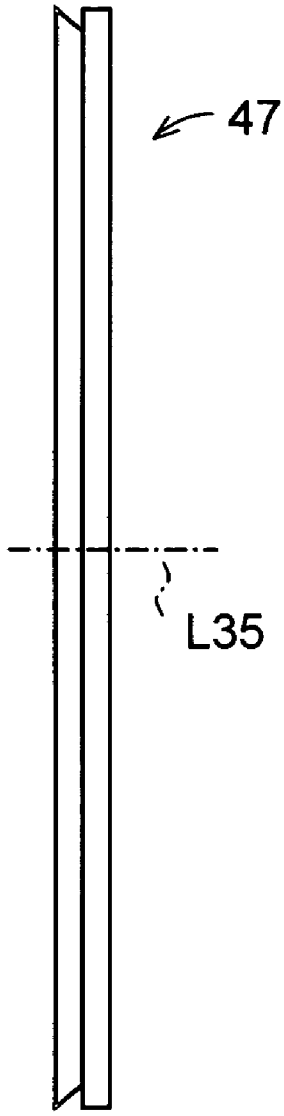
FIG. 14(*a*) is a front view illustrating a sealing member for sealing between the container main body and the supporting member.
Figure 14:
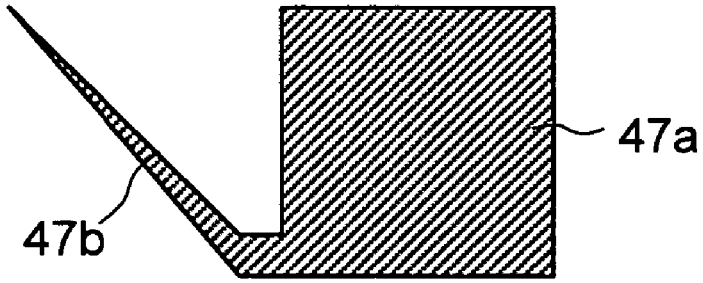

FIG. 14(*a*) is a front view illustrating a sealing material 47. FIG. 14(*b*) is a cross sectional view illustrating the sealing material 47 taken perpendicularly to its outer peripheral surface. The sealing material 47 serves as sealing means, and is made of a synthetic resin having flexibility and elasticity, such as silicone rubber. The sealing material 47 (shown in FIG. 14(*a*)) has a substantially circular ring shape. The sealing material 47 includes a base portion 47*a* and a contact portion 47*b* as shown in FIG. 14(*b*). The base portion 47*a* of the sealing material 47 has a cross section having a rectangular shape perpendicular to the outer peripheral surface of the sealing material 47, whose center is the axis line L35. The contact portion 47*b* is formed on a first end portion of the base portion 47*a*, the first end portion being one end portion in a direction along the axis line L35. The contact portion 47*b* inclines, outwardly in a radial direction of the sealing material 47, from its end portion to its other end portion.

The base portion 47*a* of the sealing material 47 has an inner peripheral surface whose diameter is smaller than the outer peripheral surface of the first container portion 33 of the container main body 31, and than that outer peripheral surface of the second container portion 34 of the container main body 31 which excludes the guiding protruding slip 40. Further, the base portion 47*a* and the contact portion 47*b* of the sealing member 47 respectively have outer peripheral surfaces whose diameters are coincident with or larger than an imaginary circle centered at the axis line L31, which passes the outer peripheral surfaces of the discharging guides 44. The sealing material 47 has a length, which is coincident with or smaller than the respective lengths of the first supporting recess portion 67 and the second supporting recess portion 68 of the supporting member 32, all the lengths here being along their respective axis lines.

Figure 15:
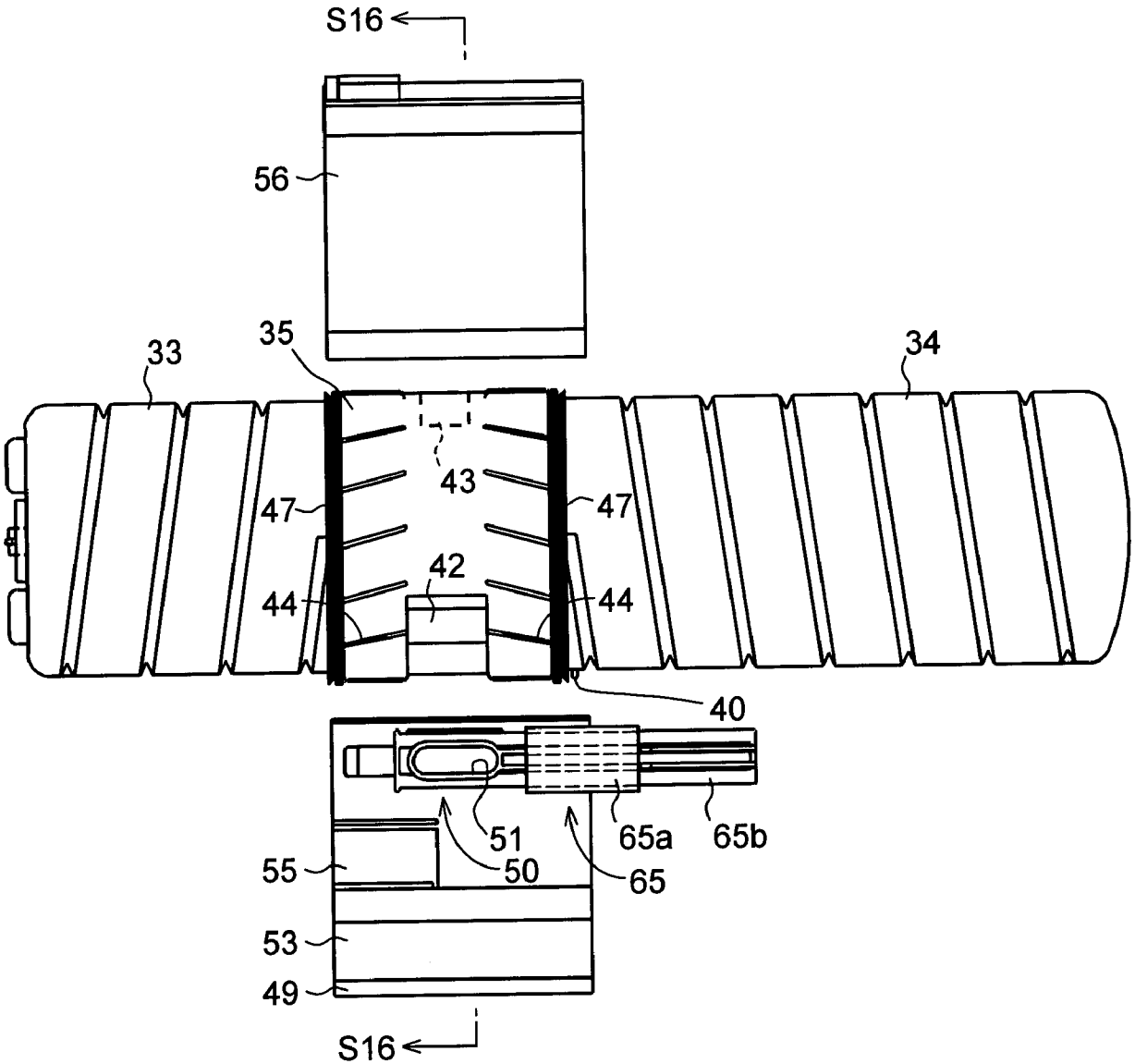
FIG. 15 is a front view illustrates an assembly of the developer container of FIG. 2.
Figure 16:
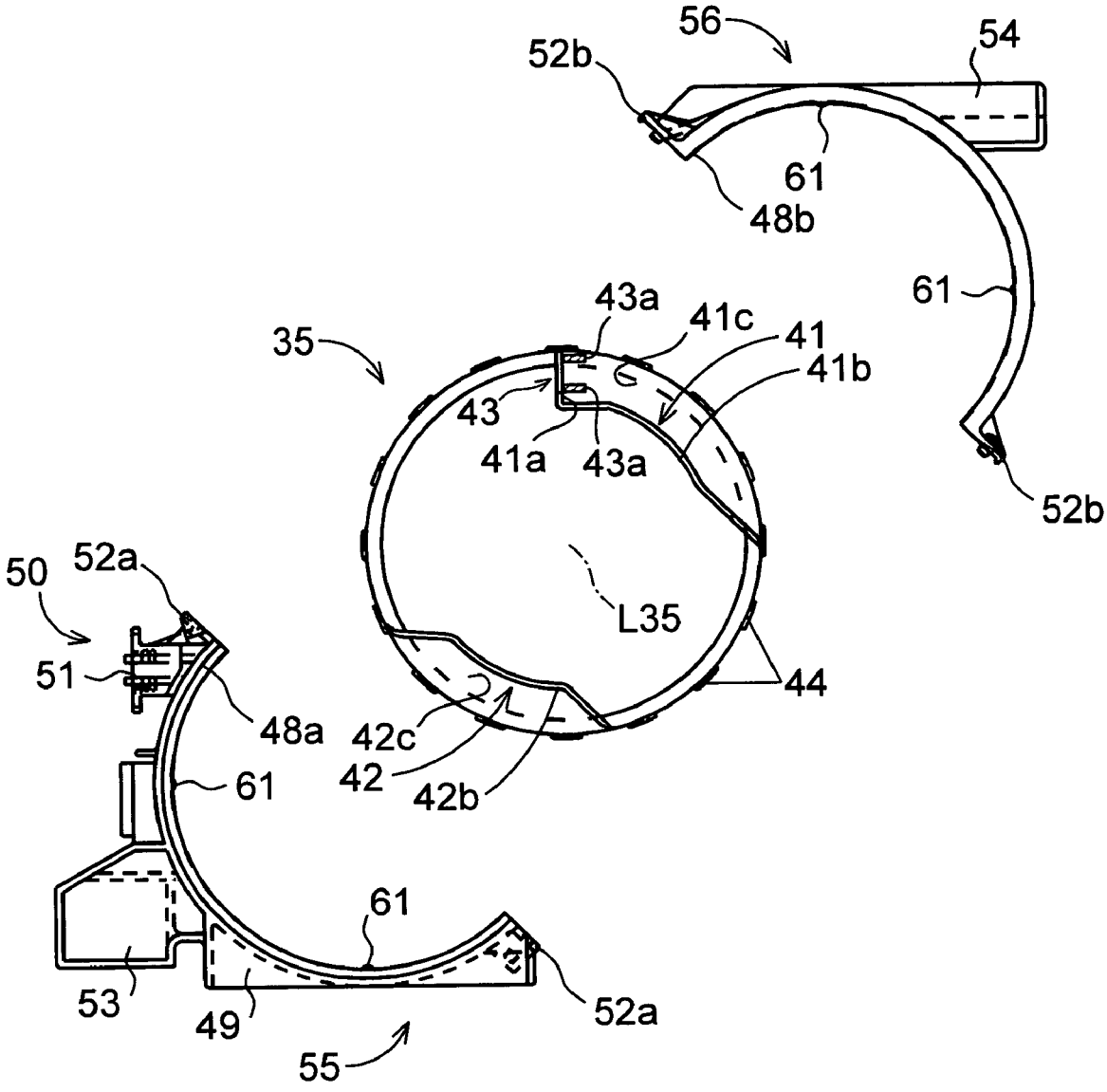
FIG. 16 is a cross sectional view illustrating the developer container (shown in FIG. 15), which is taken along a line S16—S16 of FIG. 15.

FIG. 15 is a front view illustrating an assembly of the developer container 30. FIG. 16 is a cross sectional view taken along a line S16—S16 of FIG. 15. Before the assembly, the supporting member 32 is disassembled into the first supporting section 55 and the second supporting section 56. Further, here, one of two sealing materials 47 is provided around the aperture end portion 33*b* of the first container portion 33 with a gap therebetween. Besides, the base portion 47*a* of the sealing material 47 makes close contact with the terminal surface of a first end portion of the third container portion 35, the first end portion being one end portion in the axis L35. In this way, the sealing material 47 is fixed to the first container portion 33 of the container main body 31. The other sealing material 47 is provided around the aperture end portion 34*b* of the second container portion 34. The other sealing material 47 is positioned closer to the first end portion of the second container portion 34 than the guiding protruding slip 40. Besides, the base portion 47*a* of the other sealing material 47 makes close contact with a second end portion of the third container portion 35, the second end portion being the other end portion in the axis L35. On this account, the other sealing material 47*a* is fixed to the second container portion 34 of the container main body 31.

Then, the first supporting section 55 and the second supporting section 56 is assembled so that, by being applied inwardly in the radial direction, they sandwich that portion of the container main body 31 which includes the third container portion 35. The first supporting section 55 and the second supporting section 56 thus arranged are coupled with the screw member 57.

Figure 17:
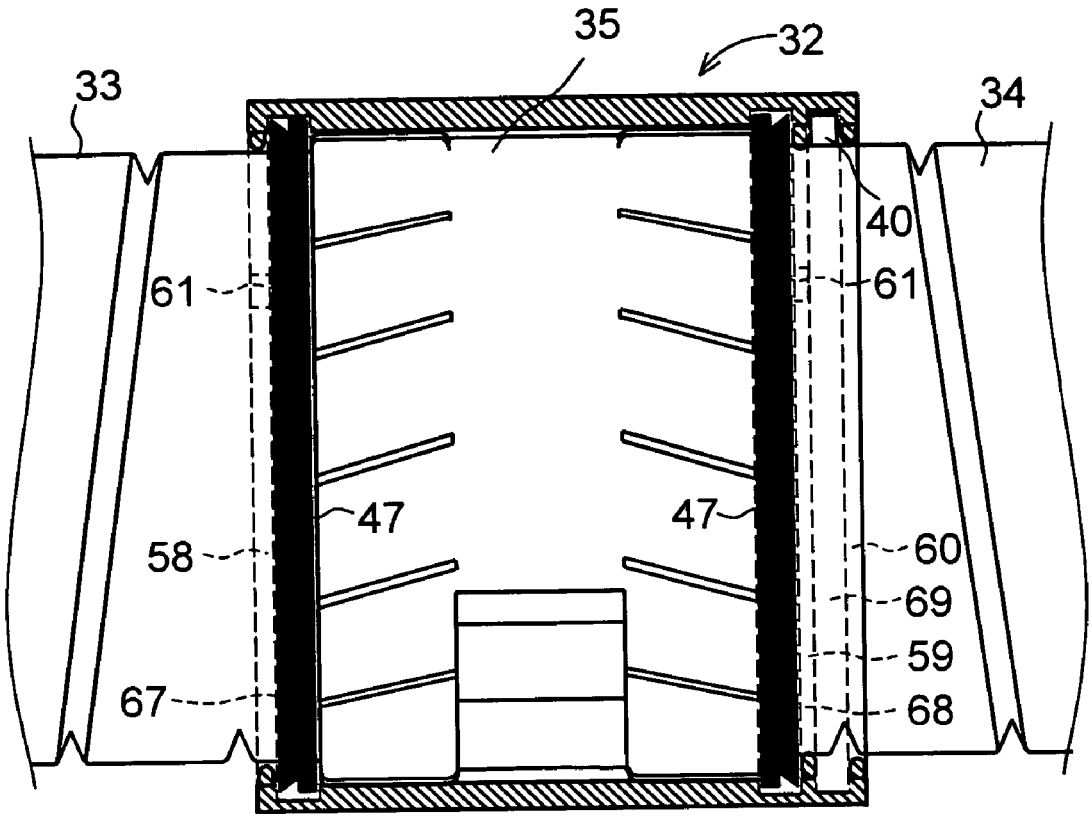
FIG. 17 is a cross sectional view illustrating the developer container (shown in FIG. 4), which is taken along a line S17—S17.

FIG. 17 is a cross sectional view illustrating the developer container 30 taken along a line S17—S17 of FIG. 4. When the container main body 31 is supported by the supporting member 32, the axis line L31 of the container main body 31 is absolutely or substantially coincident with the axis line L32 of the inner peripheral surface 48 of the supporting member 32. Therefore, the container main body 31 can be freely rotated about the axis line L31 (axis of rotation) with respect to the supporting member 32. When the supporting board 49 of the supporting member 32 is placed on a horizontal flat plane, the first container portion 33 and the second container portion 34 have a certain space from the horizontal flat plane, respectively, and the horizontal flat plane and the rotation axis line L31 are parallel to each other.

Specifically, the supporting member 32 is assembled with the container main body 31 so that the protruding supporters 61 of the first supporting rise portion 58 make contact with the outer peripheral surface of the first container portion 33, and so that the protruding supporters 61 of the second supporting rise portion 59 make contact with that outer peripheral surface of the second container portion 34 which excludes the guiding protruding slip 40. Namely, the outer peripheral surface of the first container portion 33 is supported, in four locations, by the protruding supporters 61 of the first supporting rise portion 58. The protruding supporters 61 are provided with intervals along the circumferential direction. Further, that outer peripheral surface of the second container portion 34 which excludes the guiding protruding slip 40 is supported, at four points, by the protruding supporters 61 of the second supporting rise 59. The protruding supporters 61 are provided with intervals along the circumferential direction. On this account, a frictional force against the rotation of the container main body 31 can be dramatically reduced, the frictional force occurring (i) between the outer peripheral surface of the first container portion 33 and the first supporting rise portion 58, and (ii) between the outer peripheral surface of the second container portion 34 and the second supporting rise portion 59.

The sealing material 47 of the first container portion 33 is fitted into the first supporting recess portion 67 of the supporting member 32, and elastically abuts against a surface of a whole surface of the first supporting rise portion 58, the surface being associated with the second end of the inner peripheral surface 48. The other sealing material 47 of the second container portion 34 is fitted into the second supporting recess portion 68 of the supporting member 32, and entirely makes elastic contact with a surface of the first supporting rise portion 58, the surface being associated with the first end of the inner peripheral surface 48. With the two sealing materials 47, sealed is between the supporting member 32 and the container main body 31, the first and the second recess portion of the container main body 31, and the discharging opening 43 being positioned therebetween.

The guiding protruding slips 40 of the container main body 31 are fitted into the third supporting recess portion 69 of the supporting member 32. On this account, the container main body 31 is prevented from sliding, along the axis line L31, within the supporting member 32. The outer peripheral surfaces of the discharging guides 44 each make contact with the inner peripheral surface 48 of the supporting member 32. Thus, the supporting member 32 covers and supports at least that portion of the container main body 31 which includes the first recess portion 41 in such a manner that the container main body 31 can freely rotate with respect to the rotation axis line L31.

Figure 18:
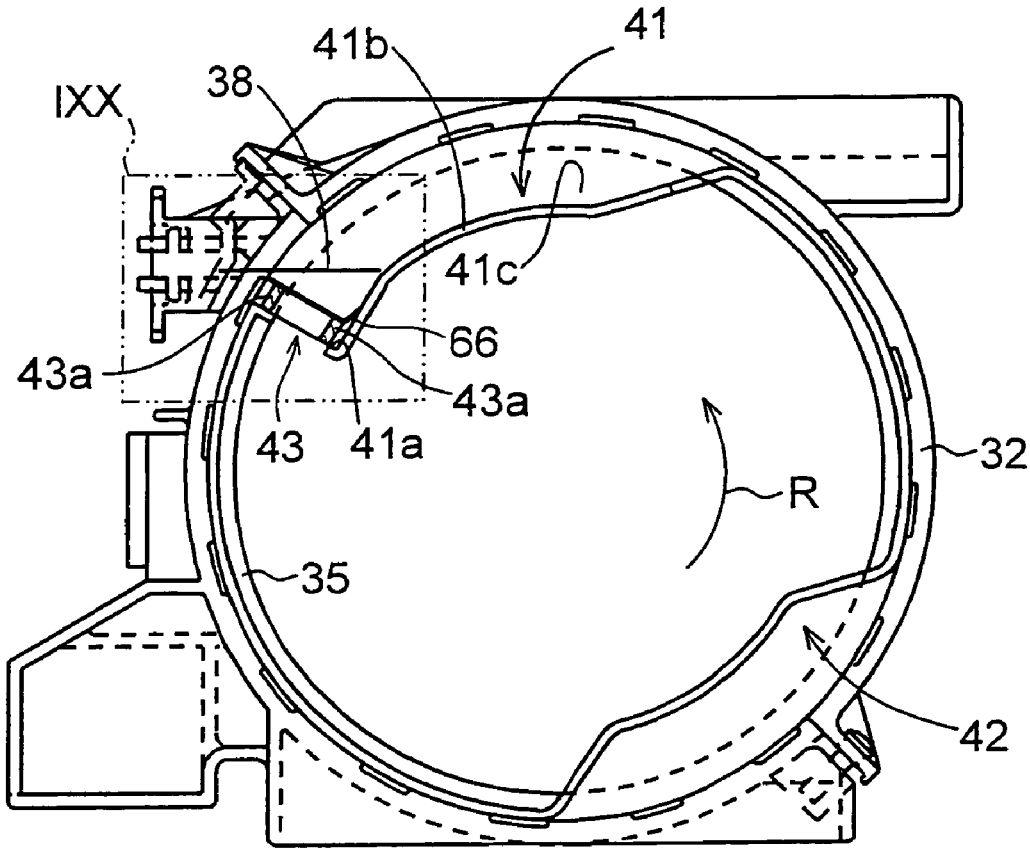
FIG. 18 is a cross sectional view illustrating the developer container (shown in FIG. 3), which is taken along a line S18—S18.
Figure 19:
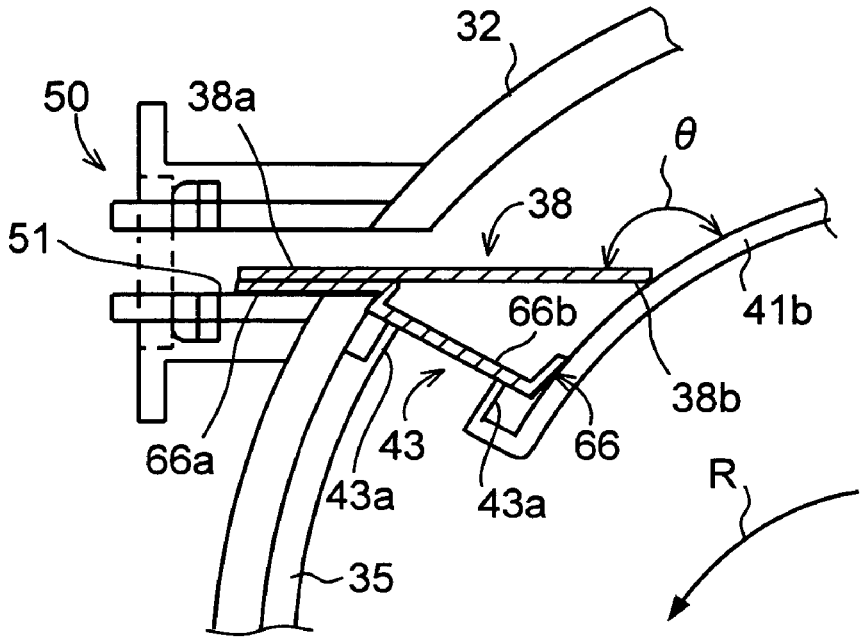
FIG. 19(*a*) and FIG. 19(*b*) are an enlarged view illustrating an IXX parts (shown in FIG. 18).
Figure 19:
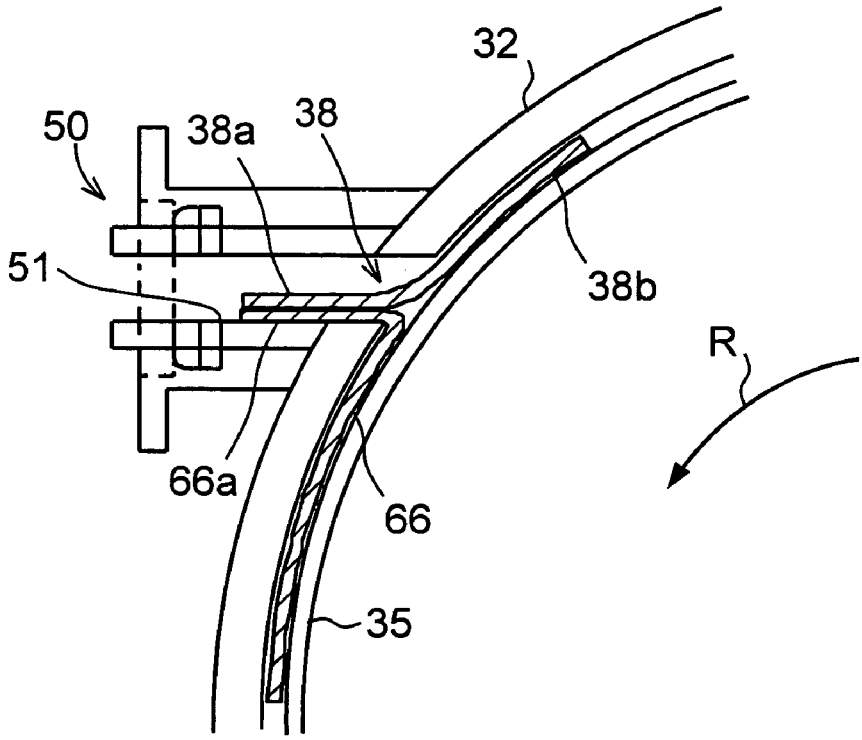

FIG. 18 is a cross sectional view illustrating the developer container 30 taken along a line S18—S18 of FIG. 3. FIG. 19(*a*) and FIG. 19(*b*) are enlarged view of IXX section indicated by a chain double-dashed line in FIG. 18. Further, FIG. 18 and FIG. 19(*a*) illustrates that the container main body 31 is in an initial state (i.e., state before carrying out the operation of discharging the developer) within the supporting member 32. In the inner peripheral surface of the supporting member 32, the leading member (leading means) 38 is provided. The leading member 38 leads the developer, discharged from the discharging opening 43 to the first recess portion 41, into the through opening 51.

The leading member 38 has the anchorage end portion 38*a* within the through opening 51, and the anchorage end portion extends, in the direction F1 (shown in FIG. 11), to that aperture end of through opening 51 which faces the inner peripheral surface 48 of the supporting member 32. Further, the leading member 38 has an unfixed portion 38*b* that can elastically abut, at an angle θ of 90', at least against the outer peripheral surfaces of the respective bottom walls 41*b* and 42*b* of the first and the second recess portions 41 and 42 of the third container portion 35 of the container main body 31. Specifically, the angle θ is formed (i) by an upper surface of the unfixed portion 38*b* and the outer peripheral surface of the bottom wall 41*b* of the first recess portion 41, and (ii) by the upper surface of the unfixed portion 38*b* and the outer peripheral surface of the bottom wall 42*b* of the second recess portion 42.

The sealing sheet 66 has an anchorage end portion 66*a* within the through opening 51, and extends, in the direction F1, to that aperture end of through opening 51 which faces the inner peripheral surface 48. The sealing sheet 66 has a portion 66*b*, which is a portion excluding the anchorage end portion 66*a*. When the container main body 31 is in the initial state with respect to the supporting member 32, the portion 66*b* detachably makes contact with the bottom walls 41*b*, by using thermal adhesion or the like, so as to cover at least the discharging opening 43 (i.e., an aperture of the regulating member 43*a*) of the terminal wall 41*a* of the first recess portion 41. Thus, in the initial state, the discharging opening 43 is covered with the portion 66*b* of the sealing sheet 66. On this account, in the initial state, even if a user accidentally locates the shutter 65 of the shutter section 65 in the opening position P2, the developer contained in the container main body 31 can be prevented from leaking out from the through opening 51.

From the initial state, the container main body 31 is rotated, in the rotation direction R, around the rotation axis line L31. The rotation causes the portion 66*b* of the sealing sheet 66 to be apart from the terminal wall 41*a* of the first recess portion 41, thereby opening the discharging opening 43. Thereafter, the portion 66*b* thus detached from the terminal wall 41*a* bends in the rotation direction R, and is disposed between the third container portion 35 of the container main body 31 and the inner peripheral surface 48 of the supporting member 32, as shown in FIG. 19(*b*). On this account, the discharging opening 43 can be open with ease, by only rotating the container main body 31, without manually removing the sealing sheet 66.

When the supporting board 49 of the supporting member 32 is placed on a flat surface, and if the developer is contained in the container main body 31, there are two layers inside the container main body 31; a developer layer 63 and an air layer formed above the developer layer 63. When the container main body 31 rotates clockwise with respect to the rotation axis line L31 (when viewed from the first container portion 33), the developer of the developer layer 63 in the first container portion 33 is led by the first protruding ledge 36, and is supplied, along the rotation axis line L31, in a first supplying direction C1 (shown in FIG. 3), to the third container portion 35. Meanwhile, the developer contained in the second container portion 34 is led by the second protruding ledge 39, and is supplied, along the rotation axis line L31, in a second supplying direction C2 (shown in FIG. 3), to the third container portion 35. By thus rotating the container main body 31 with respect to the rotation axis line L31, the developer contained in the container main body 31 can be supplied to the discharging opening 43. Further, the developer sent in the first supplying direction C1, and the developer sent in the second supplying direction C2 collide each other in the third container portion 35. This stirs the developer.

When the developer is supplied, a force toward the third container 35 from the inner peripheral surfaces of the first container portion 33 and the second container portion 34 is exerted onto the developer. When the container main body 31 contains a large amount of developer, the developer positioned within a range of the protruding amount A2 of the first and the second protruding ledges 36 and 39 is mostly stirred by the rotation of the container main body 31. On this account, the developer is kept evenly in the container main body 31.

Figure 20:
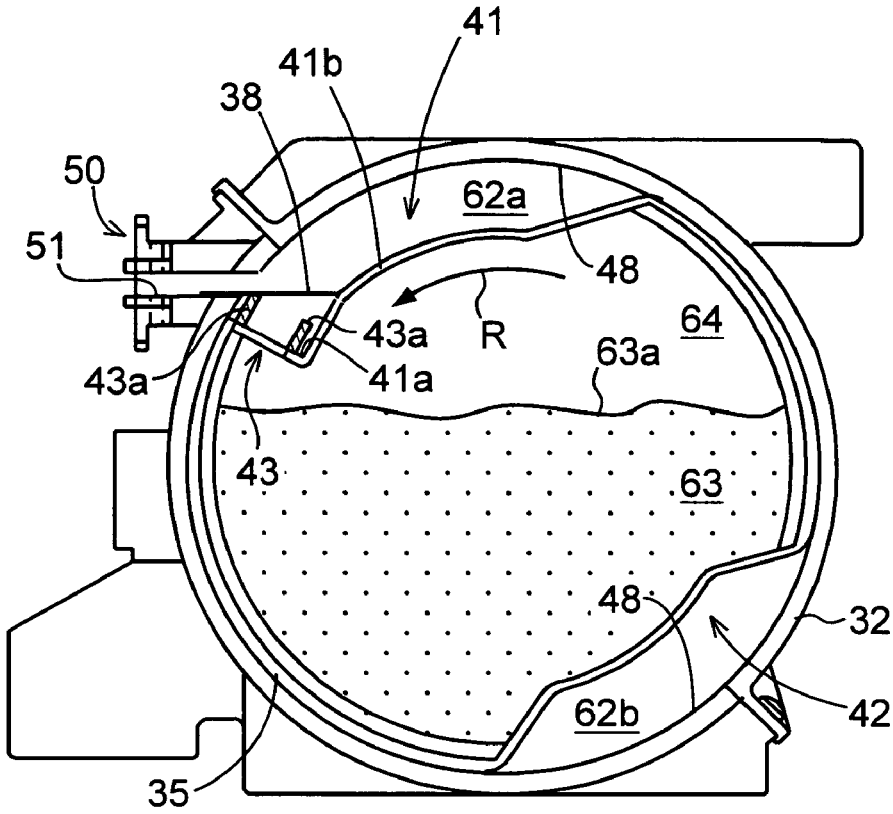
FIG. 20(*a*) and FIG. 20(*b*) are explanatory views illustrating, in the developer container (shown in FIG. 2), how the developer contained in the third container portion of the container main body is led to a through opening of the supporting member, when the container main body rotates around an axis line L31 in a rotation direction R.
Figure 20:
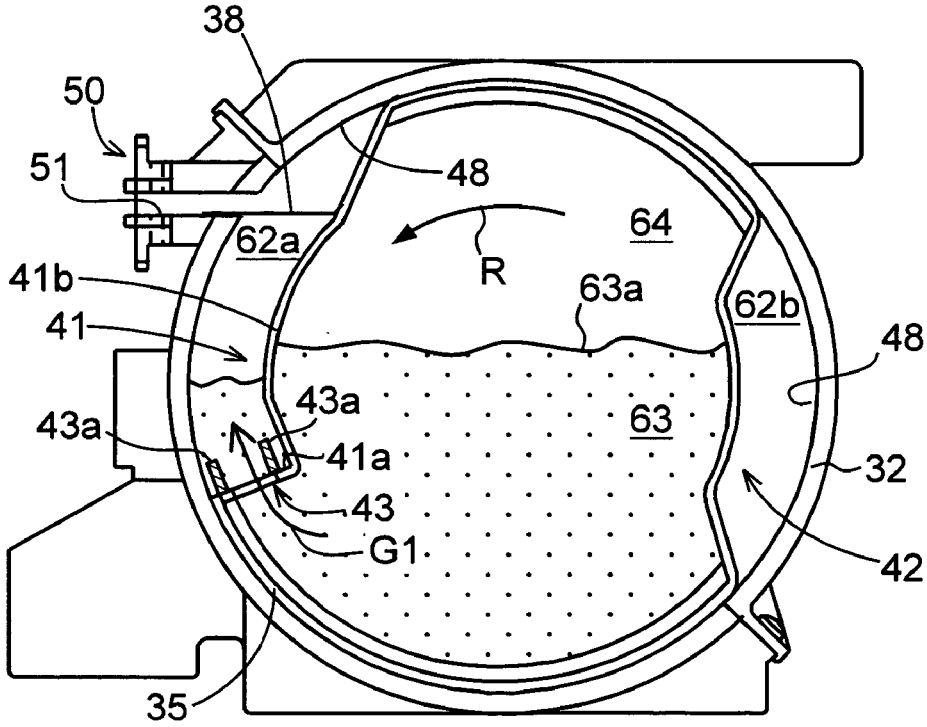
Figure 21:
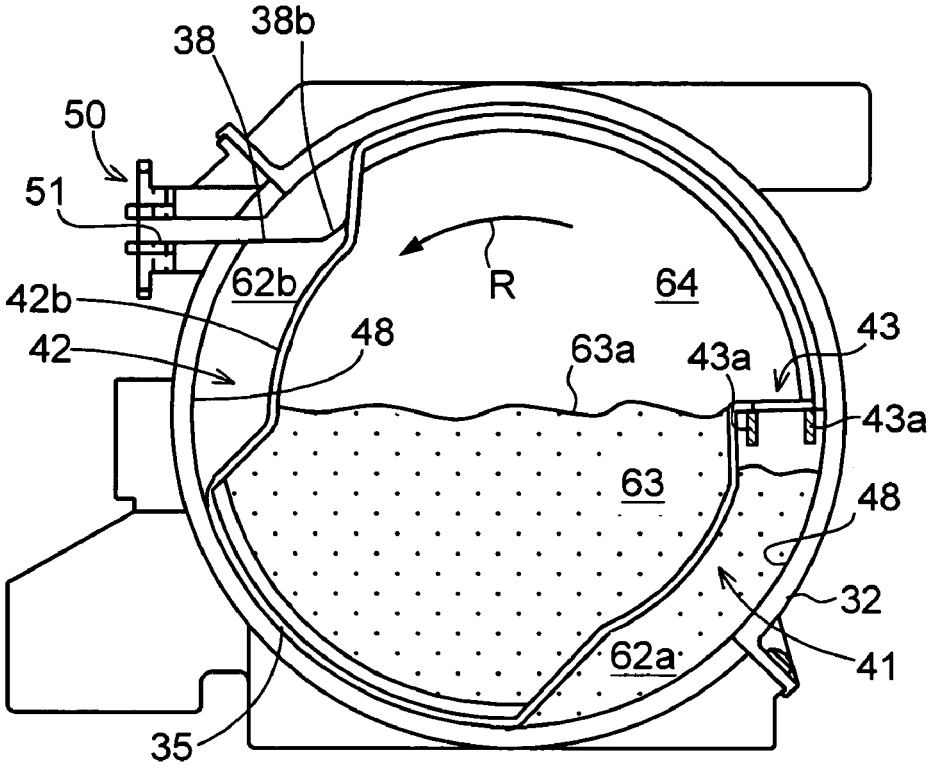
FIG. 21(*a*) and FIG. 21(*b*) are explanatory views how, after the operation shown in FIG. 20(*a*) and FIG. 20(*b*), the developer contained in the third container portion of the container main body is led to a through opening of the supporting member.
Figure 21:
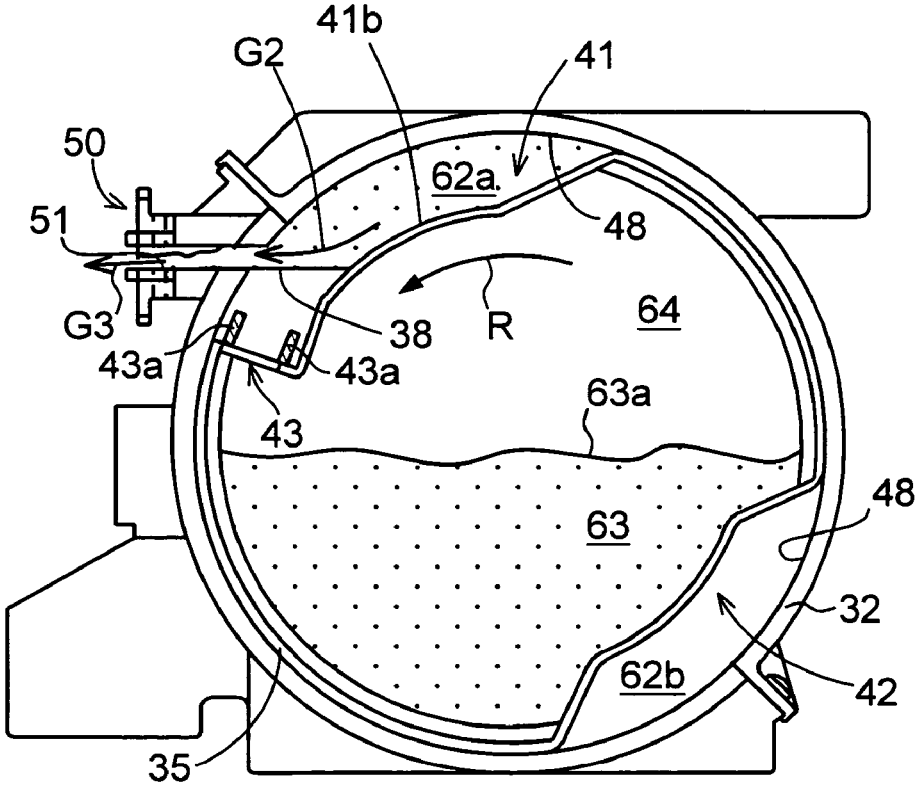

Here, the following description deals with how the developer in the third container portion 35 is led to the through opening 51 when the container main body 31 rotates, in the rotation direction R, around the rotation axis line L31, with reference to FIG. 20(*a*), FIG. 20(*b*), FIG. 21(*a*), and FIG. 21(*b*). Note that FIG. 1, FIG. 9(*a*), FIG. 9(*b*), and FIG. 17 are also referred.

When the container main body 31 is so supported by the supporting member 32 that the container main body 31 can freely rotate with respect to the rotation axis line L31, a first retention space 62*a* is formed between the first recess portion 42 of the third container portion 35 and the inner peripheral surface 48 of the supporting member 32. The first retention space 62*a* is a substantially closed space except that it is opened via the discharging opening 43, and extends from the discharging opening 43 upstream of the rotation direction R. The first retention space 62 is connected, via the discharging opening 43, to the inside of the container main body 31. Further, a second retention space 62*b* is formed between the second recess portion 41 of the third container portion 31 and the inner peripheral surface 48 of the supporting member 32. The second retention space 62*b* is a substantially closed space.

Firstly, the container main body 31 rotates, in the rotation direction R, from such a state (i.e., the initial state) that the discharging opening 43 and the first retention space 62*a* are disposed above an upper level 63*a* of the developer layer 63 of the container main body 31 as shown in FIG. 20(*a*). Then, as shown in FIG. 20(*b*), the discharging opening 43 and a part of the first retention space 62*a* are disposed below the upper level 63*a*. On this occasion, the developer of the developer layer 63 is discharged into the first retention space 62*a* via the discharging opening 43 and the regulating member 43*a* as shown in an arrow G1 of FIG. 20(*b*).

The discharging opening 43 is provided on a central portion of the terminal wall 41*a* of the first recess portion 41, specifically, on that portion of the central portion of the terminal wall 41*a* which is located outwardly with respect to the center of the central portion in the radial direction. Further, the discharging opening 43 has a rectangular shape whose longitudinal sides are along the axis line L35. Specifically, the discharging opening 43 is located: outwardly, in the radial direction, with respect to the downstream end of the bottom wall 41*b*; and closer to the second end portion of the terminal wall 41*a* than the downstream end of the first side wall 41*c*; and closer to the first end portion of the terminal wall 41*a* than the downstream end of the second side wall 41*d*. Further, the regulating member 43*a* having tube-like shape is provided perpendicular to the terminal wall 41*a* so that the regulating member 43*a* surrounds the discharging opening 43.

If the discharging opening 43 occupies the whole terminal wall 41*a*, the rotation of the container main body 31 causes the density of the developer to increase, and the developer then enters the first retention space 62*a*, via the discharging opening 43, along the first recess portion 41 of the container main body 31 and the inner peripheral surface 48 of the supporting member 32. Thereafter, the container main body 31 further rotates in the rotation direction R. This possibly causes the first recess portion 41 and the inner peripheral surface 48 to put pressure on the developer that is kept in the first retention portion 41, thereby agglomerating the developer. On the contrary, in the present embodiment, the discharging opening 43 occupies a part of the terminal wall 41*a* of the first recess portion 41 as described above. That is, the discharging opening 43 has an aperture area that is smaller than an area of the terminal wall 41*a*. On this account, the discharging opening of the first retention space 62*a* spreads the developer over the first retention space 62*a*. This allows the developer discharged into the first retention space 62*a* to be fine particles. This can prevent the developer from the agglomeration caused by the rotation of the container main body 31.

Further, if the regulating member 43*a* is not provided, it is impossible to prevent the self weight-induced flow-in of the developer when the developer is discharged into the first recess portion 41. In this case, the amount of the developer supplied to the developing section of the image forming apparatus depends on how much developer remains in the container main body 31, and the developer therefore cannot be evenly supplied. Accordingly, images cannot always be evenly formed, thereby deteriorating qualities of images. Therefore, the regulating member 43*a* is provided in the developer container 30 of the present invention so as to prevent the self weight-induced flow-in of the developer.

Figure 24:
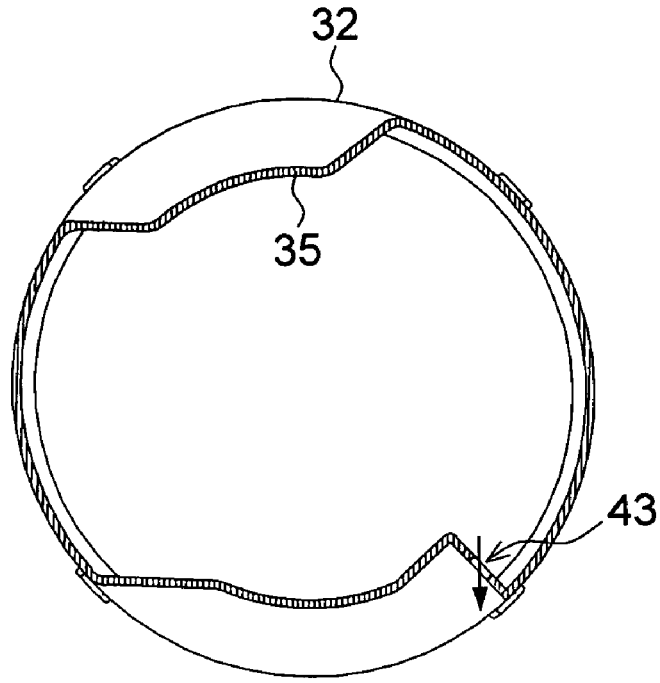
FIG. 24(*a*) is a schematic diagram illustrating a flow of a toner in a third container portion that does not include the regulating member.
Figure 24:
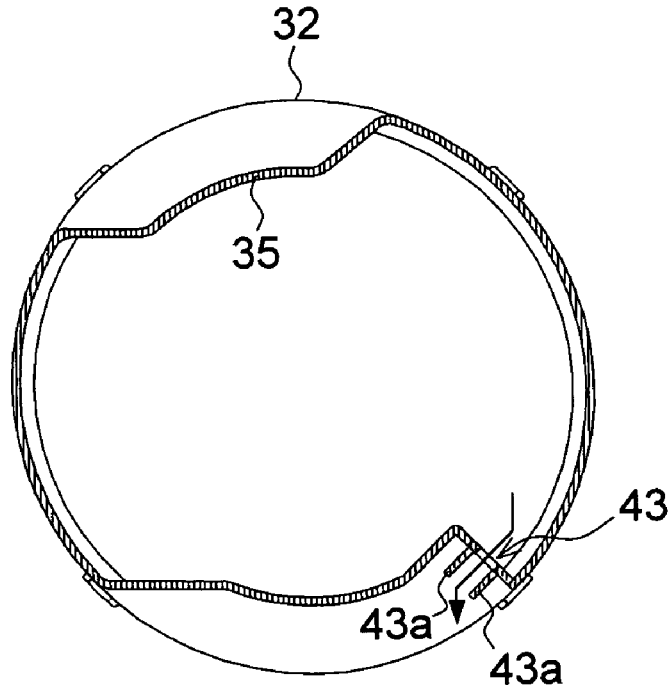
Figure 25:
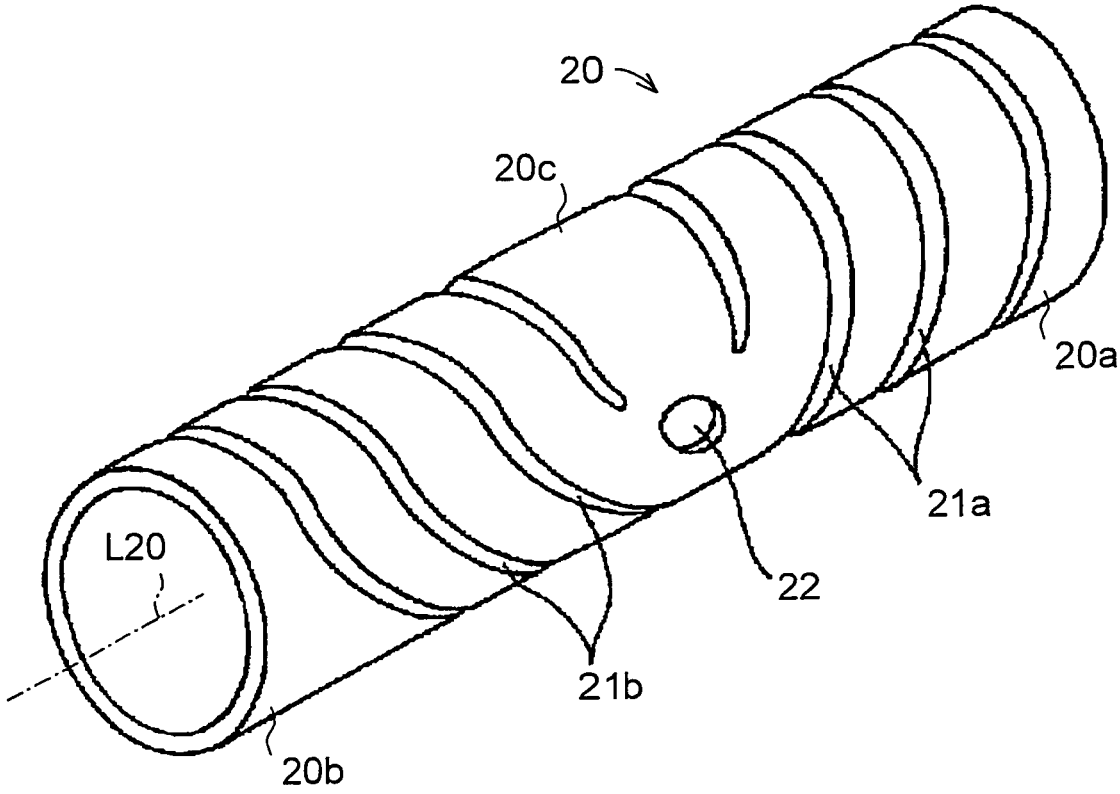
FIG. 25 is a perspective view illustrating a conventional developer container.

Here, the following description deals with how the regulating member 43*a* prevents the developer from being over supplied due to the gravitational force imposed on the developer with reference to FIG. 24(*a*), and FIG. 24(*b*). FIG. 24(*a*) and FIG. 24(*b*) illustrate when the first recess portion 41 (see also FIG. 1) of the third container portion 35 is in the vicinity of a bottom dead center. The bottom dead center is a location in which the first recess portion 41 is positioned at a bottom of the rotation, and in which the maximum loads of the gravity is imposed on the developer. Note that FIG.

24(*a*) shows an arrangement in which the regulating member 43*a* is not provided. In contrast, FIG. 24(*b*) shows an arrangement in which the regulating member 43*a* is provided. Note also that indicated by respective arrows of FIG. 24(*a*) and FIG. 24(*b*) are the self weight-induced flow-in of the developer.

See FIG. 24(*a*). In the case where the regulating member 43*a* is not provided, the gravity of the developer causes the developer to directly enter the first recess portion 41 from the discharging opening 43. Therefore, when a good deal of the developer is left in the container main body 31, the developer has a heavy weight. Accordingly, a heavy gravity is imposed on the developer. This causes a large amount of the developer to flow into the first recess portion 41. Further, because the developer is increased in density by the load of the heavy gravity, the developer per unit volume becomes large, thereby further increasing the amount of the developer flowing into the first recess portion 41. Meanwhile, when the remaining amount of the developer is small in the container main body 31, the developer has a light weight. Accordingly, a light gravity is exerted on the developer. This causes a small amount of the developer to flow into the first recess portion 41. Further, because the developer is less dense, the developer per unit volume becomes small, thereby further decreasing the amount of the developer flowing into the first recess portion 41. As such, in the case where the regulating member 43*a* is not provided, the developer cannot be stably supplied, thereby making it impossible to evenly form images. This causes qualities of the images to be deteriorated. Further, the developer increased in density by its weight is agglomerated while supplied to the developer section. Accordingly, the developer thus agglomerated is not only coagulated and fused, but also overloads a rotation torque of the image forming apparatus. This possibly damages a driving system of the image forming apparatus.

On the contrary, in the case where the regulating member 43*a* is provided as shown in FIG. 24(*b*), even when the first recess portion 41 is disposed in the vicinity of the bottom dead center, the regulating member 43*a* diverts the inflow of the developer as indicated by the arrow of FIG. 24(*b*). On this occasion, a resistant force is exerted against the load of the gravity, thereby preventing the weight of the developer from causing the developer to directly flow into the first recess portion 41 via the discharging opening 43. Specifically, the regulating member 43*a* ensures that such a discharging direction (i.e., the inflow indicated by the arrow of FIG. 24(*b*)) that the developer is discharged from the discharging opening 43 when the first recess portion 41 is positioned in the vicinity of the bottom dead center is not integrated with the direction of gravity on the developer. This prevents weight-induced acceleration of the developer to be supplied to the first recess portion 41. Therefore, the regulating member 43*a* allows the developer to be always evenly supplied from the developer container 30 to the developing section, irrespective of how much the developer is left in the developer container 60.

The regulating member 43*a* preferably has such a shape, and is preferably provided in such a location that the discharging direction (the inflow) of the regulating member 43*a* is orthogonal to the direction of the gravitational force on the developer. Therefore, such a regulating member may be, for example, the regulating member 43*a*, in accordance with the present embodiment, having a tube-like shape, the regulating member 43*b* (shown in FIG. 7(*b*)) having a plate-like shape, or the like. These regulating members can effectively prevent the weight of the developer from causing the developer to be over supplied to the first recess portion 41.

Further, that side of the discharging opening 43 which is positioned outwardly in the radial direction of the third container portion 35 is connected with that inner peripheral surface of the third container portion 35 which excludes the first and the second recess portions 41 and 42. On this account, even when the remaining amount of the developer is small in the container main body 31, the developer can be easily supplied to the first retention space 62*a* via the discharging opening 43.

When the container main body 31 further rotates in the rotation direction R from the state shown in FIG. 20(*b*), the developer of the developer layer 63 in the container main body 31 enters the first retention space 62*a* via the discharging opening 43, and flows into the downstream of the first retention space 62*a*. Thereafter, the container main body 31 is further rotated to such a position that the discharging opening 43 is above the upper level 63*a* of the developer layer 63 of the container main body, and that the first retention space 62*a* is below the upper level 63*a*, as shown in FIG. 21(*a*). In this state, a predetermined amount of the developer is kept in the first retention space 62*a*. The amount of the developer kept in the first retention space 62*a* is preferably in a range of 50% to 90% of containing volume of the first retention space 62*a*.

Next, the container main body 31 further rotates, in the rotation direction R, from the position of the FIG. 21(*a*) to a position shown in FIG. 21(*b*). On this occasion, the unfixed portion 38*b* of the leading member 38 of the supporting member 32 enters the first retention space 62*a*. The unfixed portion 38*b* elastically abuts, at an angle θ of 90° or greater, against the outer peripheral surface of the bottom wall portion 41*b* of the first recess portion 41. The unfixed portion 38*b* slides along the surface of the bottom wall portion 41*b*. Thereafter, the container main body 31 further rotates in the rotation direction R, thereby flowing the developer toward the supporting member 32, the developer being kept in that portion of the first retention space 62 which is above the leading member 38.

As indicated by an arrow G2 of FIG. 21(*b*), the leading member 38 leads the developer thus discharged (i.e., the developer discharged from the discharging opening 43 of the container main body 31), along its upper surface, into the through opening 51. Because the leading member 38 slides in such a manner that the leading member 38 scrapes out the developer from the outer peripheral surface of the bottom wall portion 41*b*, even the last part of the developer that is kept in the first retention space 62*a* can be sent to the through opening 51. In other words, the leading member 38 leads the developer to the through opening 51 in such an order of from (a) the developer positioned in that downstream portion of the first recess portion 41 which is located in a downstream of the rotation direction R, to (b) the developer positioned in that portions of the first recess portion 41 which are located in an upstream of the rotation direction R. The developer thus led to the through opening 51 is ejected to outside of the developer container 30. As such, each time the container main body 31 rotates, in the rotation direction R, with respect to the rotation axis line L31, a predetermined amount of the developer is discharged to outside.

As described above, in the whole circumference, the inner peripheral surface 48 of the supporting member 32 does not wholly make contact with that portion of the third container portion 35 which excludes the first recess portion 41 and the second recess portion 42. This is for reducing the frictional force against the rotation of the container main body 31 around the rotation axis line L31. For this reason, there is a little possibility that the developer, which is kept in the first retention space 62*a* as described above, leaks out from the first retention space 62*a*. To solve the problem, the discharging guides 44 are provided on that outer peripheral surface of the third container portion 35 which excludes the first recess portion 41 and the second recess portion 42. The discharging guides 44 provided in the first end portion of the third container portion 35 inclines, in the rotation direction R, from the first end portion toward the second end portion of the third container portion 35. Also, the discharging guides 44 provided in the second end portion of the third container portion 35 inclines, from the second end portion toward the first end portion of the third container portion 35, with respect to the rotation direction R. On this account, even if the developer that is kept in the first retention space 62*a* leaks out toward the first and the second end in the axis line L31 while the container main body 31 rotates in the rotation direction R, the developer thus leaked can be gathered, by the discharging guides 44, in the central portions of the third container portion 35 and the supporting member 32.

Further, even if the developer that is kept in the first retention space 62*a* leaks out from the upstream of the first retention space 62*b*, the developer thus leaked out, and the developer thus gathered in the central portions by the discharging guide 44 are kept in the second retention space 62*b*. When the container main body 31 rotates in the rotation direction R, the unfixed portion 38*b* of the leading member 38 of the supporting member 32 enters the second retention space 62*b* as shown in FIG. 21(*a*). The unfixed portion 38*b* is extended in the upstream direction of the rotation direction R, thereby elastically abutting against the surface of the bottom wall portion 42*b* of the second recess portion 42 at an angle θ of 90° or greater. The unfixed portion 38*b* slides, along the outer peripheral surface of the bottom wall portion 42*b*, from the upstream of the second recess portion 42, in the rotation direction R.

On this occasion, by the rotation of the container main body 31, the developer that is kept in the second retention space 62*b* is led, along the leading member 38, in the direction of the supporting member 32, to the through opening 51. Then, the developer is discharged to the outside of the developer container 30. As such, the second retention space 62*b* allows the predetermined amount of the developer to be securely discharged to outside even if the developer leaks out from the first retention space 62*a* each time the container main body 31 rotates, in the rotation direction R, with respect to the rotation axis line L31.

Further, as described above, the discharging portion 50 protruding in the direction F1 (that is one horizontal direction when the supporting board is placed on a horizontal flat plane) is provided on the upper portion of the supporting member 32. In the central portion of the discharging portion 50, the through opening 51 having an oval shape is formed. The through opening 51 penetrates the discharging portion 50 in the direction F1, and extends parallel to the axis line L32. On this account, even when the container main body 31 is filled up with the developer, the upper level 63*a* of the developer layer 63 is disposed as high as the through opening 51, or is disposed below the through opening 51. This securely prevents the developer from unintentionally flowing out from the developer container 31 to the through opening 51.

As described above, according to the developer container 30 of the present embodiment, the container main body 31 can rotate around the rotation axis line L31 while the container main body 31 is stably supported by the supporting member 32. In cases where a conventional developer container having a cylindrical shape is placed perpendicularly to a horizontal flat plane for a period of time, developer therein is possibly agglomerated in a lower portion of the conventional developer container. Further, even if the conventional developer container is placed parallel to the horizontal flat plane in order to prevent the agglomeration as much as possible, the conventional developer container rolls. On the contrary, the developer container 30 of the present embodiment is arranged so that, by placing the supporting board 49 of the supporting member 32 on the horizontal flat plane, the container main body 31 can be so disposed that the axis line L31 of the container main body 31 is always parallel to the horizontal flat plane. Further, even if the developer contained in the developer container 30 is partially agglomerated, the developer thus agglomerated can be brought back to the powder form with ease, for example, by manually moving the shutter 65*a* of the shutter section 65 to the closing position P1, and rotating the container portion 31 to stir the developer, the developer is brought back to the powder form.

Further, the developer container 30 of the present embodiment is arranged so that the regulating member 43*a* is provided in the discharging opening 43. This prevents the self weight-induced flow-in of the developer into the first recess portion 41, as described above. Therefore, the supply amount of the developer becomes independent from the amount of the developer left in the developer container 30. On this account, the developer can be more stably supplied to the developing section.

Further, the developer container 30 of the present embodiment is arranged so that a discharge amount of the developer depends on the volume of the first retention space 62*a*, and on a rotation speed of the container main body 31. In the present embodiment, the developer container 30 is arranged so that the discharging opening 43 is provided only in the first recess portion 41. However, the present invention is not limited to this. For example, in cases where it is necessary to discharge a larger amount of the developer by each rotation of the container main body 31, the second recess portion 42 may have the same shape as the first recess portion 41, and may include the discharging opening 43 and the regulating member 43*a*. Further, the developer container 30 may include more recess portions and more discharging openings.

Further, the developer container 30 of the present embodiment is preferably arranged so that the developer (toner) contained in the container main body 31 has a particle diameter of 7 μm or less. An intermolecular force becomes stronger in inverse proportion to the particle diameter of the developer including toner and the like. The developer is possibly agglomerated, and this causes blocking and puncturing with ease. However, even when the developer has a particle diameter of 7 μm or less, i.e., even when the developer becomes easily agglomerated due to the strong intermolecular force, the developer container 30 of the present embodiment ensures that the developer is prevented from being discharged excessively to the developing section. On this account, the developer can be prevented from being agglomerated.

The following description explains an image forming apparatus 70 in which the developer container 30 is detachably provided, the image forming apparatus 70 being one example of the present invention.

Figure 23:
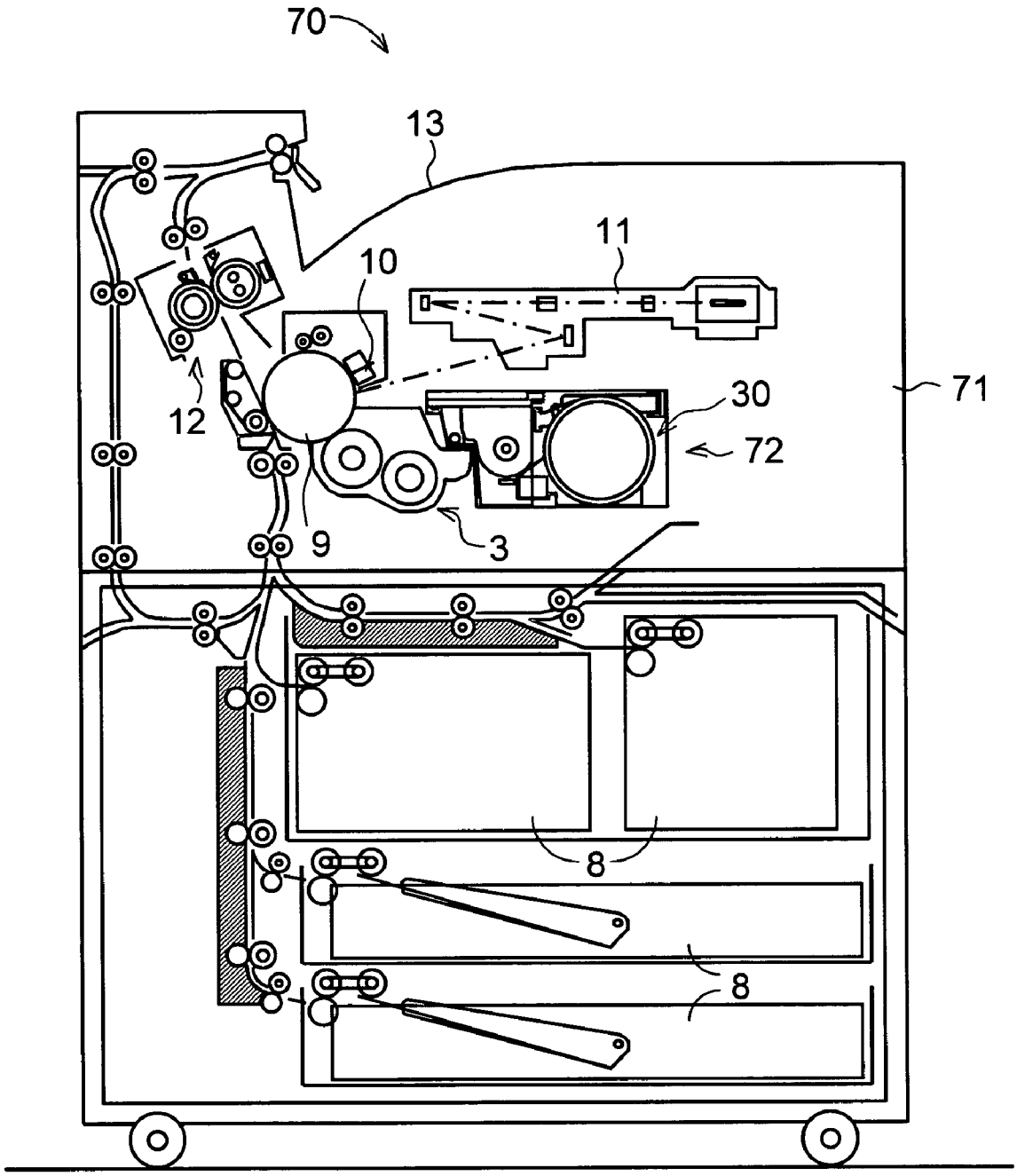
FIG. 23 is a cross sectional view illustrating an image forming apparatus of one embodiment of the present invention.

FIG. 23 is a cross sectional view illustrating the image forming apparatus 70. The image forming apparatus 70 is an image forming apparatus of an electro-photographical type such as a printer, photocopier, and the like. The image forming apparatus 70 includes an image forming apparatus main body 71 having the developer container 30. The developer container 30 is detachably provided in a toner hopper 72 of the image forming apparatus main body 71 via a container inlet (not shown) of a front chassis (not shown) of the image forming apparatus main body 71. The container inlet can be arbitrarily opened and closed.

Apart from the developer container 30, the image forming apparatus main body 71 further includes a developing section 3, a sheet cassette 8, and a discharge tray 13. The developing section 3 develops an image with the use of the developer supplied from the toner hopper 72. The sheet cassette 8 contains sheets, on which an image is formed. Further, the developing section 3 includes a photosensitive drum 9, a charging section 10, a laser exposure section 11, a fixing section 12, and the like. The photosensitive drum 9 is a cylindrical drum having a photoreceptor on its outer peripheral surface, and rotates with respect to its axis line. The charging section 10 electrifies the photoreceptor of the photosensitive drum 9 so as to give photosensitivity to the photoreceptor. By using a laser beam, the laser exposure section 11 exposes the photoreceptor of the photosensitive drum 9 which has been charged. Hereby, the laser exposure section 11 forms an electrostatic latent image on the photoreceptor. The fixing section 12 fixes a toner image, which has been transferred onto a sheet.

The developing section 3 stirs the developer supplied from the toner hopper 73, and supplies the developer to the photosensitive drum 9, on which the electrostatic latent image is formed, so as to develop the image. In this way, a toner image that corresponds to the electrostatic latent image is formed. The photosensitive drum 9 transfers the toner image, which is formed on the photosensitive drum 9, to the sheet supplied from the sheet cassette 11. The sheet on which the toner image is formed is delivered to the discharge tray 13. Note that, except for the toner hopper 72, the image forming apparatus has the same structure to a well-known conventional image forming apparatus.

According to the image forming apparatus 70, the developer is stably supplied, to the developing section from the developer container 30, irrespective of how much the developer is left in the developer container 30. This prevents blocking and puncturing caused by the agglomeration of the developer, thereby improving an image quality.

Further, the developer container of the present invention is arranged so that the recess portion includes a terminal wall on its downstream end which is downstream with respect to the rotation direction, the terminal wall having a surface orthogonal to the rotation direction, and a discharging opening formed in the terminal wall.

According to the arrangement, even when the remaining amount of the developer is small in the container main body, the developer is reliably discharged into the discharging opening. Therefore, even when the remaining amount of the developer is small, the amount of the developer being supplied does not change. On this account, the developer can always be stably supplied.

The developer container of the present invention is preferably arranged so that a regulating member is so provided on the terminal wall of the recess portion that the regulating member is perpendicular to the terminal wall.

According to the arrangement, the inflow of the developer (i.e., such a direction that the developer is discharged from the discharging opening when the recess portion is disposed in the vicinity of the bottom dead center) is not integrated with a direction of the gravitational force exerted on the developer. This prevents the weight of the developer from causing the developer to directly flow into the first recess portion 41. On this account, the developer can be always evenly supplied from the developer container to the developing section, irrespective of how much developer is left in the developer container.

The developer container of the present invention is arranged so that the supporting means includes leading means (leading member) in its inner peripheral surface, the leading means leading, to the through opening, the developer discharged from the discharging opening of the container main body.

According to the arrangement, the developer discharged into the recess portion can be led to the through opening. Further, the arrangement prevents the developer from being over supplied to the developing section. On this account, the developer is prevented from being agglomerated, and from accordingly causing blocking while the developer is sent to the developing section.

The developer container of the present invention is preferably arranged so that the leading means (leading member) leads the developer to the through opening from (a) the developer positioned in that downstream portion of the recess portion and thereafter (b) the developer positioned in those portions of the recess portion which are located upstream of the rotation direction.

The developer container of the present invention is preferably arranged so that the developer contained in the container main body has a particle diameter of 7 μm or less.

The developer container of the present invention is preferably arranged so that the recess portion and the discharging opening are formed on a substantially central portion of the axis line (axis of rotation). According to this arrangement, by rotating the container main body, the developer contained in a portion which is associated with the first end portion of the container main body, and the developer contained in a portion which is associated with the second end portion of the container main body collide with each other in the vicinity of the discharging opening of the container main body. If the developer container is arranged so that the developer is supplied to the first end portion of the container main body, the developer to be supplied is possibly agglomerated by pressure exerted from an inner wall perpendicular to an axis line of the first end portion of the developer container.

The present invention ensures that the developer contained in the portion which is associated with the first end of the container main body, and the developer contained in the portion which is associated with the second end of the container main body can collide with each other in the vicinity of the discharging opening of the container main body, i.e., in the substantially central portion of the container main body. This stirs the developer. On this account, even if the developer contained in the developer container is agglomerated, the rotation of the container main body makes it possible to bring the developer back to the powder form by stirring it.

Further, the developer container of the present invention is preferably arranged so that the regulating member has a tube-like shape.

The developer container of the present invention is preferably arranged so that the container main body is manufactured by blow forming.

The developer container of the present invention is arranged so that, the container main body has a second recess portion on the outer peripheral surface thereof, the second recess portion being located oppositely to the recess portion with respect to the axis line. According to this arrangement, even when a remaining amount of the developer is small, the recess portion and the second recess portion ensure that the developer can be effectively gathered in the vicinity of the discharging opening of the container main body. This prevents the supply amount of the developer from decreasing. On this account, images can be prevented from being unevenly developed.

The developer container of the present invention is preferably arranged so that (1) the container main body including (i) a first container portion that has a cylindrical shape having a closed end; (ii) a second container portion that has a cylindrical shape having a closed end; and (iii) a third container portion that has a cylindrical shape, and that includes the recess portions and the discharging opening; and (2) the container main body is so manufactured in one piece that a first end portion of the third container portion is connected to an aperture end portion of the first container portion, and that a second end portion of the third container portion is connected to an aperture end portion of the second container portion, the first end portion being an end portion in the axis line, and the second end portion being the other end portion in the axis line.

According to the arrangement, it is possible to realize the container main body, (i) in which the recess portion and the discharging opening are formed in the central portion of the axis line of the container main body, and (ii) whose end portions in the axis line are closed. Further, it is possible to manufacture, in one piece, the container main body including the first, the second, and the third container portions by, for example, blow forming.

Further, the developer container of the present invention is preferably arranged so that a material of the leading means (leading member) is a polymer resin, and has a sheet-like shape.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A developer container, comprising:

a container main body, configured to be detachably provided in an image forming apparatus, containing a developer for use in image formation, the container main body having a cylindrical shape and an axis of rotation; and a supporting member which supports the container main body in such a manner that the container main body is freely rotatable relative thereto in a predetermined direction about said axis of rotation, wherein:

the container main body has an outer peripheral surface, a recess portion on that outer peripheral surface, the recess portion being inwardly depressed and having a discharging opening therein positioned to discharge contained developer into the recess portion upstream of the direction of rotation of the container main body about the axis of rotation;

the developer contained in the container main body being sent to the discharging opening in response to rotation of the container main body around the axis of rotation;

the supporting member supports the container main body by wholly covering at least that portion of the container main body which includes the recess portion in such a manner that the container main body is freely rotatable about the axis of rotation;

the supporting member includes a through opening for leading discharged developer from the recess portion to the outside of the supporting member; and a regulating member is provided in the discharging opening for regulating the amount of developer discharged through said discharging opening.

2. The developer container as set forth in claim 1, wherein:

the recess portion includes a terminal wall on its downstream end having a surface orthogonal to the rotation direction, the discharging opening being formed in the terminal wall.

3. The developer container as set forth in claim 2, wherein:

the regulating member is so provided on the terminal wall that the regulating member is perpendicular to the terminal wall.

4. The developer container as set forth in claim 1, wherein:

the supporting member includes leading means in its inner peripheral surface, for leading, to the through opening, the developer discharged from the discharging opening into the recess portion of the container main body.

5. The developer container as set forth in claim 4, wherein:

the leading means leads the developer to the through opening from (a) the developer positioned in the downstream portion of the recess portion and thereafter (b) the developer positioned in those portions of the recess portion which are located upstream with respect to the rotation direction.

6. The developer container as set forth in claim 4, wherein:

the leading means is comprised of a polymer resin, and has a sheet-like shape.

7. The developer container as set forth in claim 1, wherein:

the developer contained in the container main body has a particle diameter of 7 μm or less.

8. The developer container as set forth in claim 1, wherein:

the recess portion and the discharging opening are located on a substantially central portion along the axis of rotation.

9. The developer container as set forth in claim 1, wherein:

the regulating member has a tube-like shape.

10. The developer container as set forth in claim 9, wherein:

the container main body is manufactured by blow forming.

11. The developer container as set forth in claim 1, wherein:

the container main body has a second recess portion on the outer peripheral surface thereof, the second recess portion being located oppositely to the recess portion with respect to the axis of rotation.

12. The developer container as set forth in claim 1, wherein:

the container main body includes:

a first container portion that has a cylindrical shape having an apertured end and a closed end;

a second container portion that has a cylindrical shape having an apertured end and a closed end; and a third container portion that has a cylindrical shape, having apertured end portions disposed along the axis of rotation and that includes the recess portion and the discharging opening; and the container main body is so assembled that a first end portion of the third container portion is connected to the apertured end portion of the first container portion, and that a second end portion of the third container portion is connected to the apertured end portion of the second container portion along the axis of rotation.

13. The developer container as set forth in claim 1, wherein the discharging opening is sealed by a sealing sheet detachably provided at the discharging opening prior to any rotation of the container main body, and the sealing sheet has an anchorage end portion fixed at the through opening, and the sealing sheet is detached from the discharging opening in response to the rotation of the container main body, so that the discharging opening is exposed.

14. An image forming apparatus, comprising:

a developer container, configured to be detachably provided to contain a developer for use in an image formation; and a developing section for developing an image with the use of developer supplied from the developer container, wherein:

the developer container of the present invention includes: (1) a container main body, configured to contain a developer for use in image formation, the container main body having a cylindrical shape and an axis of rotation; and (2) a supporting member which supports the container main body in such a manner that the container main body is freely rotatable with respect thereto in a predetermined direction about the axis of rotation;

the container main body has an outer peripheral surface, a recess portion on that outer peripheral surface, the recess portion being inwardly depressed and having a discharging opening therein positioned to discharge contained developer into the recess portion upstream of the direction of rotation of the container main body about the axis of rotation;

developer contained in the container main body being sent to the discharging opening in response to rotation of the container main body around the axis of rotation;

the supporting member supports the container main body by wholly covering at least that portion of the container main body which includes the recess portion;

the supporting member includes a through opening for leading discharged developer from the recess portion to the outside of the supporting member; and a regulating member is provided at that surface of the recess portion in which the discharging opening is provided for regulating the amount of developer discharged through said discharging opening.

* * * * *